US010547933B2

(12) United States Patent
Dekel

(10) Patent No.: US 10,547,933 B2
(45) Date of Patent: Jan. 28, 2020

(54) LOUDSPEAKER AND METHOD OF ITS MANUFACTURE

(71) Applicant: NOVEL ACOUSTICS LTD., Netanya (IL)

(72) Inventor: Boaz Dekel, Even Yehuda (IL)

(73) Assignee: Novel Acoustics Ltd., Netanya (IL)

( * ) Notice: Subject to any disclaimer, the term of this patent is extended or adjusted under 35 U.S.C. 154(b) by 0 days.

(21) Appl. No.: 15/745,782

(22) PCT Filed: Jul. 21, 2016

(86) PCT No.: PCT/IL2016/050803
§ 371 (c)(1),
(2) Date: Jan. 18, 2018

(87) PCT Pub. No.: WO2017/013663
PCT Pub. Date: Jan. 26, 2017

(65) Prior Publication Data

US 2018/0206027 A1 Jul. 19, 2018

Related U.S. Application Data

(60) Provisional application No. 62/194,917, filed on Jul. 21, 2015.

(51) Int. Cl.
*H04R 1/28* (2006.01)
*H04R 1/02* (2006.01)

(52) U.S. Cl.
CPC ..... *H04R 1/2888* (2013.01); *H04R 1/021* (2013.01); *H04R 1/025* (2013.01); *H04R 1/288* (2013.01);
(Continued)

(58) Field of Classification Search
CPC ..... H04R 1/2888; H04R 1/021; H04R 1/025; H04R 1/2857; H04R 1/288; H04R 2201/029
See application file for complete search history.

(56) References Cited

U.S. PATENT DOCUMENTS 3,473,625 A 10/1969 Heisrath
4,655,315 A 4/1987 Saville
(Continued)

FOREIGN PATENT DOCUMENTS

CN 1438818 A 8/2003
CN 102014321 A 4/2011
(Continued)

OTHER PUBLICATIONS

International Search Report for PCT/2016/050803—a counterpart foreign application—dated Nov. 8, 2016, 3 pages.
(Continued)

*Primary Examiner* — Andrew L Sniezek
(74) *Attorney, Agent, or Firm* — Roach Brown McCarthy & Gruber, P.C.; Kevin D. McCarthy

(57) ABSTRACT

An enclosure unit for a speaker device is presented. The enclosure unit comprises an integral elongated hollow body defining a cavity for mounting therein an electronic unit of the speaker. The hollow body has a distal end portion, defining an open end of the enclosure unit through which sound reproduced by said electronic unit is output, a proximal end portion having an open end, and an intermediate portion in between the distal end and proximal end portions. The proximal end portion of the hollow body is coupled to the intermediate portion at a certain location on the intermediate portion thereby defining a toroidal-like portion of the hollow body. A cross sectional dimension of an interior of the hollow body reduces from the distal end portion towards the proximal end portion.

19 Claims, 17 Drawing Sheets

(52) U.S. Cl.
CPC ..... *H04R 1/2857* (2013.01); *H04R 2201/029* (2013.01)

(56) References Cited

U.S. PATENT DOCUMENTS

| | | | | |
|---|---|---|---|---|
| 4,819,761 | A | 4/1989 | Dick | |
| 6,078,676 | A * | 6/2000 | Takenaka | H04R 1/345 181/145 |
| 6,356,643 | B2 * | 3/2002 | Yamagishi | H04R 1/2857 181/148 |
| 6,377,696 | B1 * | 4/2002 | Nevill | H04R 1/2819 181/199 |
| 7,284,638 | B1 | 10/2007 | Sahyoun | |
| 8,205,712 | B2 | 6/2012 | Dickie | |
| 9,479,861 | B2 * | 10/2016 | Bisset | H04R 1/2819 |
| 2004/0084245 | A1 * | 5/2004 | MacKin | H04R 1/00 181/156 |
| 2004/0146172 | A1 * | 7/2004 | Goswami | H04R 5/033 381/378 |
| 2007/0284184 | A1 * | 12/2007 | Krueger | H04R 1/2857 181/151 |
| 2008/0006477 | A1 | 1/2008 | Huang | |
| 2009/0084624 | A1 * | 4/2009 | Dickie | H04R 1/2819 181/152 |

FOREIGN PATENT DOCUMENTS

| | | |
|---|---|---|
| GB | 2290672 A | 1/1996 |
| GB | 2298758 A | 9/1996 |
| GB | 2333927 A | 8/1999 |

OTHER PUBLICATIONS

Written Opinion of International Searching Authority for PCT/2016/050803—a counterpart foreign application—dated Nov. 8, 2016, 4 pages.

* cited by examiner

Impulse Response Spectral Analysis - Material: Rigid525

Impulse Response Spectral Analysis - Material: BlankB

Impulse Response Spectral Analysis - Material: BlankC VeroWhite

Impulse Response Spectral Analysis - Material: BlankC _TangoBlack

Impulse Response Spectral Analysis - Material: BlankD

Impulse Response Spectral Analysis - Material: BlankE

Impulse Response Spectral Analysis - Material: BlankF

Impulse Response Spectral Analysis - Material: BlankG

LOUDSPEAKER AND METHOD OF ITS MANUFACTURE

TECHNOLOGICAL FIELD AND BACKGROUND

The present invention relates to speakers, in particular loudspeakers, and the speaker's enclosure configuration, and to a method for manufacturing the same.

Loudspeakers reproduce original, recorded signals. The performance of a loudspeaker is evaluated its ability to faithfully reproduce the original source wave form, namely a degree of match between the profile (frequency and amplitude profile) of a loudspeaker's output signal and the original source signal.

One of the main parts of a speaker (e.g. loudspeaker) affecting the loudspeaker performance is a speaker enclosure (e.g. cabinet), in which an electroacoustic transducer(s) (hereinafter also referred to interchangeably as speaker driver(s)) and associated electronic hardware are mounted. Speaker enclosures may be of a simple box-like design, or may be a complex cabinet, including composite materials, internal baffles, horns, ports and acoustic treatment (absorption, diffusion, stuffing, insulation).

To improve the performance of a speaker, it is desired for the enclosure/cabinet of a speaker to be substantially neutral with respect to the signal being reproduced, such that the system's resonance(s) caused by the signal interaction with and propagation in the enclosure is/are reduced/minimized.

Also, the loudspeaker should be configured with reduced backwave distortion effects. The backwave distortion is induced by interaction between sound waves generated by the rearward-facing surface of a diaphragm with sound waves generated at the front of the driver. This is because interaction of the forward- and backward-generated sounds (which are out of phase with each other) in the listening space creates a distortion of the original signal to be reproduced. Accordingly the forward and backward sound waves arrive at the listener's position at slightly different times, thereby resulting in loss of detail and clarity of the reproduced sound and damage to the stereo image and sound stage. Various techniques have been developed to solve this problem. A common approach for most, if not all, of these techniques, is based on filling the speaker enclosure by foam or other fibrous or porous material(s) to absorb backward-generated sounds. This, however, reduces the quality of the output signal, e g making the system sound "muffled". Also, acoustic absorption is not equally effective at all frequencies and is amplitude dependent. This means that not all the frequencies are attenuated uniformly, and the louder the speaker plays, the less effective it becomes (since more absorption is required to achieve a desired result).

GENERAL DESCRIPTION

There is a need in the art for a novel approach in configuring a speaker (e.g. loudspeaker), especially its enclosure, to improve the speaker performance.

It should be understood that the term speaker is used in the context of the present application to designate any device/module, which includes and/or is configured as an acoustic transducer, particularly electroacoustic.

The present invention provides a novel configuration of the speaker's enclosure, which improves the profile of an output signal of the speaker, i.e. to match that of the original signal. The present invention solves the problems of backwave distortion and enclosure neutrality effects, by providing a novel geometry and a novel material structure of the enclosure unit.

It should be noted that for clarity and without loss of generality, the speaker's enclosure is at times referred to in the following as "cabinet". More specifically, the invention deals with improvement of loudspeaker performance and is therefore described below with respect to this specific application. However, the scope of the invention should not be limited to loudspeakers.

The speaker enclosure/cabinet of the invention is configured for reducing or substantially preventing backward generated sound waves from being output from the loudspeaker. It should be understood that "backward generated waves" and "forward degenerated waves" are sound/acoustic waves emerging in opposite directions, respectively, from a source/generator of the acoustic waves, i.e. a loudspeaker.

The speaker's enclosure of the present invention is configured as an integral hollow body, which can be schematically and functionally divided into three functionally different hollow portions fluidly connected to one another to form the cabinet body. More specifically the cabinet body has a distal end portion, defining an open end of the cabinet, at which an electroacoustic transducer (e.g. a speaker, loudspeaker or other source/generator of the acoustic waves, and possibly also additional components/circuits such as crossovers, and/or amplifiers, and/or DSP(s) (digital signal processor(s)) can be furnished, an intermediate portion, which is fluidly connected to the distal end portion, and has the form of a closed loop (ring like) acoustical propagation channel, and a proximal end portion which is formed at a region of intersection of the closed loop intermediate portion with itself and having an open end fluidly connected to the intermediate portion.

Thus, the intermediate portion of the cabinet body, forming a closed loop (ring like) acoustical propagation channel, is fluidly connected in between the distal and proximal end portions. Hence, the cabinet body, particularly the intermediate portion thereof, is a toroidal-like/ring-like hollow portion, formed by a curve (e.g. a complete turn) of the intermediate part of the hollow body, such that it intersects with itself. The proximal end portion of the body defines an acoustic coupling portion which is formed at the intersection of the intermediate portion of the body with itself. More specifically, the proximal end portion is coupled to the intermediate portion at a certain location on the intermediate portion (at the intersection), and provides acoustic coupling for causing acoustic waves propagating along the intermediate portion to couple and re-enter into the intermediate portion when reaching the intersection so that these waves again propagate in the intermediate portion. It should be understood that most sound waves (the major part thereof, for example except negligible backscattered portions thereof) propagate through the intermediate portion of the cabinet in the same turning direction from which they came over and over again (i.e. in a perpetual fashion).

To this end, as indicated above, the cabinet body is hollow, and its interior cavity is elongated and extends in between its distal and proximal ends thereby functioning as a waveguide that directs the back generated acoustic waves from the distal end portion of the body (from the loudspeaker) to propagate in certain direction through the closed loop intermediate portion, such that wave components reaching the distal end portion of the body are coupled again to the intermediate portion to propagate therethrough for additional path(s) in the same direction. A cross sectional dimension (e.g. diameter) of the interior of the hollow body reduces from the distal end portion towards the proximal end portion. The cabinet body therefore has a horn-like shape, and more specifically a reverse-horn configuration/structure configured so that the size of the narrow end of the horn at the proximal end portion fits within the size of the wide end of the horn at its distal end portion (i.e. which is the wider end of the horn near/at the speaker site) without totally obstructing the opening and still allowing the back-wave (originating at the speaker site and being directed towards the proximal end) to diffract/pass around the narrow end of the horn and enter the closed-loop channel defined by the intermediate portion of the cabinet. The effect of the shrinking section area causes an impedance mismatch, but such effect is minimized because the transition of the widths/cross-sectional area from the wide (distal) to the narrow (proximal) ends of the horn is smooth and gradual. Some reflections/scattering may occur, but most of the wave does enter and backwave distortion is significantly reduced. At the narrow end of the horn (proximal end portion) where the wave is looped back to perform a second cycle, the impedance mismatch works in favor of the loop (because at the proximal end portion the cross-sectional section area suddenly and abruptly grows when advancing in the wave propagation direction) and draws the wave in for another turn. This is particularly effective in embodiments of the invention, such as illustrated in FIGS. 3A-3C, 4A-4C, 5A-5C, and 6A-6B, in which the proximal end is implemented as an aperture/window which intersects the intermediate portion without protruding thereto.

Generally, the proximal end portion (narrow end of the horn) is formed of, or includes, an aperture (e.g. an opening, and/or an acoustic window/membrane) located at/near the intersection of the closed loop intermediate portion with itself. The aperture/opening is directed/oriented such that acoustic waves propagating from the intermediate portion of the body and crossing the aperture of the proximal end, are fed back to propagate through the intermediate portion in the same direction (same direction as that at which they were propagating in the intermediate portion before crossing the aperture of the proximal end). This allows backward generated sound waves from a loudspeaker at the distal end to enter the closed-loop channel (formed by the intermediate portion) and recirculate (get trapped) therein until their amplitudes/intensities are diminished (e.g. by natural decay over time, destructive interferences with themselves/or other acoustical waves of similar wavelengths which enter/propagate the intermediate portion, or via acoustic absorbance of the inner walls of the body/intermediate-portion).

According to some embodiments, the aperture/opening of the proximal end portion is located at the intersection of the proximal end portion with the intermediate portion. In some other embodiments, the proximal end portion includes an extension portion of the hollow body, which at least partially enters (extends into) the intermediate portion and further extends thereinside. In this case, the aperture of the proximal end is at the termination of the extension portion within the cavity of the intermediate portion of the cabinet. In this connection, preferably, the configuration is such that the aperture and/or the extension portion of the proximal end are oriented such that acoustic waves circulating in the intermediate section and propagating therethrough, are directed by the aperture/extension portion to propagate in the intermediate portion of the body in the same direction at which acoustic waves from the distal end portion enter the intermediate portion. This provides that acoustical waves propagating in the intermediate portion of the body and reaching the proximal end are fed back to propagate through the intermediate portion in the same direction as before, while also the backward generated sound waves arriving from the loudspeaker at the distal end enter and propagate in the closed-loop channel of the intermediate portion in the same direction and get trapped therein.

The configuration of the cabinet body as described above provides efficient absorbance of the backwaves emanating from the acoustic transducer installed at the distal end portion of the enclosure. More specifically, the intermediate portion is configured to function efficiently as an acoustic absorber. This is because the geometry of the cabinet which facilitates the acoustic waves circulation within the closed loop of the intermediate portion of the cabinet, whereby every round of circulation absorbs a certain fraction of the circulating acoustic energy/waves, and whereby the degree if acoustic absorption is promoted by the horn structure (e.g. by the gradual reduction in the cross-sectional area of the closed loop channel along the propagation direction) which facilitates many impacts and reflections of the acoustic waves with the materials of/within the cabinet/walls. Every interaction of the acoustic waves propagating in the cabinet with the material thereinside, absorbs some of the energy of the waves and directs the rest of the waves energy to continue recirculate in a perpetual fashion. Indeed according to various implementations of the invention the acoustic absorbance of the cabinet is further improved by utilizing acoustically absorbing materials/structures in the intermediate/proximal portions (e.g. near/at the walls thereof) to absorb the acoustic waves/energy propagating therein (for example utilizing a multi-layer structure formed by functionally different material compositions as described in more details below).

Also, the configuration of the cabinet body as described above enables destructive interference between the trapped acoustic waves/energy recirculating in the intermediate portion and the incremental addition of acoustic waves/energy which enters the distal end portion to the intermediate portion. This further diminishes the intensity of the back propagating waves from the loudspeaker and reduces their acoustical artifacts.

Thus, the speaker enclosure configuration of the present invention, makes efficient acoustic absorber for the back propagating waves, since the energy of these acoustic waves is mostly trapped and recirculates through the intermediate and proximal portions (most of their intensity does not escape from the intermediate portion), until their amplitudes/intensities are diminished by via acoustic absorbance of the inner walls or other absorbent materials/structures of the body/intermediate-portion, and possibly also by destructive interference (e.g. with themselves/or with other acoustical waves of similar wavelengths which enter/propagate the intermediate portion) or natural decay over time.

In order to efficiently reduce the acoustical artifact of the backwaves, it is preferable to prevent/or reduce as much as possible the amount/intensity of the backwaves escaping the speaker's enclosure, and to keep them propagating within the enclosure until that are diminished via absorbance in the cabinet walls or via mutual interference. To this end, according to some embodiments of the present invention the apertures/interface regions, which couple the proximal- and the distal-end portions to the intermediate portion are configured to face the same general propagation direction through the intermediate portion. The efficiently prevents/reduces propagation of waves from the intermediate portion towards the distal end opening at which the acoustical transducer is furnished and thus prevent or at least significantly reduces the amount/intensity of the backwaves escaping the speaker's enclosure.

Keeping in mind that the cabinet body defines a sound propagation path/channel for sound being reproduced by the loudspeaker's driver(s), the cabinet body of the present invention creates an integral waveguide structure formed by a closed-loop channel portion and a through path portion, with a varying cross-sectional dimension/area of the waveguide along its length. This configuration of the cabinet body, on the one hand, provides an optimal backwave absorbance conditions by causing backwave propagation sound of various frequencies to circulate and absorb in the closed-loop channel, while allowing those corresponding to the original signal to propagate in the through path towards the distal end, to be output from the loudspeaker, thus providing a high-degree matching between the profile of the reproduced output signal and the original signal.

Preferably, the walls of the cabinet body present a multi-layer and/or patterned structure configured to further improve the loudspeaker's performance, by providing desired cabinet neutrality and reducing the backwave distortion effects. Such a multi-layer and/or patterned structure includes an acoustic waves' absorber, being a single-layer or a multi-layer (elastomeric) material composition, enclosed between outer and inner substantially rigid highly-reflective layers. The material composition of the outer and inner reflective layers may be the same or not.

Preferably, the inner reflective layer is formed with a surface pattern of features which present refractive interfaces arranged so as to direct acoustic waves propagating through this layer to enter the absorber. Moreover, these features preferably have different configurations, e.g. are of different lattice and/or diminishing and/or fractal geometries (shapes and dimensions), to act as refractive interfaces for signal components of different frequencies.

In some embodiments, one or more of the above layers may be of varying thicknesses along the cabinet body. For example, the absorber may be thicker within the extension part of the end portion which is located/extends inside the intermediate portion of the cabinet body.

Thus, according to one broad aspect of the invention, it provides an enclosure unit for a speaker device, the enclosure unit comprises an integral hollow body, whereby said hollow body includes:

- a distal end portion defining a cavity for mounting therein an acoustic transducer of the speaker device and having an open end through which forward propagating acoustical waves from said acoustic transducer output; and
- a closed-loop acoustic waveguide channel fluidly connected to said distal end portion, arranged for receiving back propagating acoustical waves emanating from said acoustic transducer, and configured and operable for guiding said back propagating acoustical waves for propagation in the closed-loop in a perpetuating fashion until intensity of said pack propagating acoustical waves is diminished.

According to some embodiments of the present invention the cross sectional dimension of an interior of the closed-loop acoustic waveguide channel to reduces towards the proximal end portion thereof.

According to some embodiments of the present invention an intermediate portion of the hollow body (defining the closed loop waveguide channel) is configured for absorbing a predetermined range of acoustic wavelengths and thereby reduce the intensity of the pack propagating acoustical waves during their propagation in the closed loop waveguide channel. In some implementations the intermediate portion of the hollow body includes a patterned structure defining walls of said intermediate portion. The patterned structure includes one or more absorber regions configured and operable for absorbing a predetermined range of acoustic wavelengths, and regions having at least one of substantially reflective and substantially refractive properties for that range of acoustic wavelengths For instance the patterned structure may be a multi-layer structure including an absorber layer, enclosed between substantially outer and inner layers. At least the inner layer, and possibly/typically also the out layer is/are substantially rigid. The inner layer may include a pattern of features configured as refractive interfaces for directing at least some of the acoustic waves interacting with therewith towards the absorber layer.

Thus, according to another broad aspect of the invention, it provides an enclosure unit for a speaker device, the enclosure unit comprising an integral elongated hollow body defining a cavity for mounting therein an electronic unit of the speaker (e.g. an acoustic transducer), said hollow body having a distal end portion, defining an open end of the enclosure unit through which sound reproduced by said electronic unit is output, a proximal end portion having an open end, and an intermediate portion in between the distal and end portions, wherein the proximal end portion of the hollow body is coupled to the intermediate portion at a certain location on the intermediate portion thereby defining a toroidal-like portion of the hollow body, and wherein a cross sectional dimension of an interior of the hollow body reduces from the distal end portion towards the proximal end portion.

According to yet another broad aspect of the invention, it provides an enclosure unit for a speaker device, the enclosure unit comprising an integral elongated hollow body having a distal end portion, defining an open end of the enclosure unit through which reproduced sound is output, a proximal end portion having an open end, and an intermediate portion in between the distal and end portions, wherein the proximal end portion of the body is coupled to the intermediate portion at a certain location on the intermediate portion defining a toroidal-like portion of the enclosure body.

According to yet further aspect of the invention, it provides an enclosure unit for a speaker device, the enclosure unit comprising an integral elongated hollow body having a distal end portion, defining an open end of the enclosure unit through which reproduced sound is output, a proximal end portion having an open end, and an intermediate portion in between the distal and end portions, wherein the proximal end portion of the body partially enters the intermediate portion at a predetermined location on said intermediate portion and extends inside the intermediate portion from said location in a direction back from the distal end portion.

The invention also provides a loudspeaker device comprising the above-described cabinet/enclosure unit, and an electronic unit configured for converting electric signals corresponding to an original sound into reproduced output sound. The electronic unit is located inside the cabinet body at a location closer to the distal end portion of the cabinet body.

In its further aspect, the invention provides a loudspeaker device comprising the above-described cabinet/enclosure unit having an integral elongated hollow cabinet body, which carries an electronic unit within an inner cavity of the body. Optionally in some implementations several speakers (transducers) and/or crossover(s) and/or an amplifier(S) and/ or DSP(s), may be mounted within an opening defined by the toroidal-like portion of the cabinet body.

In yet further broad aspect of the present invention there is provided an enclosure unit for a speaker device. The enclosure unit includes a hollow body defining a cavity for mounting therein an acoustic transducer of the speaker device and having an open end through which forward propagating acoustical waves from the acoustic transducer output. According to this aspect of the invention the walls of at least a portion of the hollow body include a patterned multi-layered structure which includes at least one absorber layer enclosed between outer and inner layers. The at least one absorber layer is configured and operable for absorbing a predetermined range of acoustic wavelengths. The inner and outer layers are substantially rigid layers and have at least one of for the range of acoustic wavelengths. The inner layer may also include a pattern of features configured as refractive interfaces for directing at least some of the acoustic waves interacting with said interfaces towards said absorber layer.

The present invention also provides a novel method of manufacturing a loudspeaker's enclosure. It should be noted that although in the description below this method is exemplified as being used for manufacturing the above-described enclosure unit of the invention, the method may be advantageously used manufacturing any other loudspeaker. The method of the invention provides for manufacturing the cabinet body by a 3D printing technique and/or by additive manufacturing techniques.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION OF EMBODIMENTS

Figure 1A:
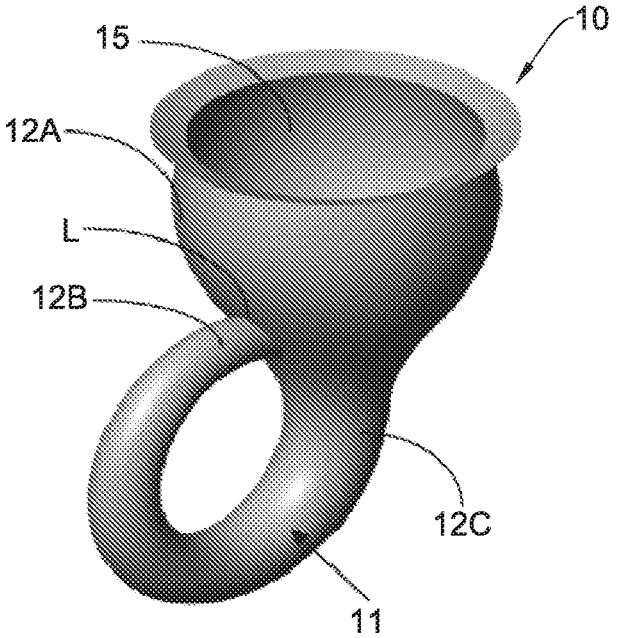
FIGS. 1A-1B, 2A-2B, 3A-3C, 4A-4C, 5A-5C and 6A-6B illustrate respectively six configurations of a speaker's cabinet body configured according to the principles of the invention.

The present invention provides a novel configuration of the loudspeaker cabinet, aimed at improving the loudspeaker performance, by eliminating or at least significantly reducing the backwave distortion effects and providing desired cabinet neutrality effect. As indicated above, this is achieved in the present invention due to a novel geometry and material structure of the cabinet unit/body.

Reference is made together to FIGS. 1A-1B, 2A-2B, 3A-3B, 4A-4C, 5A-5C, and 6A-6B illustrating respectively six examples of a speaker's cabinet/enclosure configured according to the principles of the invention. The cabinet of the present invention is configured as an integral elongated hollow body 10, which has a distal end portion 12A, defining an open end 15 of the cabinet, a proximal end portion 12B having an open end, and an intermediate portion 12C in between the distal end and proximal end portions. It should be noted, that in some embodiments of the present invention a cross sectional dimension (e.g. diameter) of the interior of the hollow body 10 reduces from the distal end portion 12A towards the proximal end portion 12B. The cabinet body 10 forms a turn such that the proximal end portion 12B of the body defines/has an aperture forming a fluid coupling of the intermediate portion 12C with itself at a certain location L on the intermediate portion 12C. Thus, the cabinet body 10 has a toroidal-like (e.g. closed-loop/ring-like) portion formed by connection of the intermediate portion with itself. The coupling location L is selected to be located at a back side of the speaker diaphragm (not shown here) located inside the cabinet body.

The configuration of the cabinet body 10 of the invention creates an integral waveguide structure formed by a closed-loop waveguide channel $W_1$ (resonator) and a through path channel $W_2$, e.g. with a varying cross-sectional dimension of the waveguide along its length, i.e. reducing from the distal end portion 12A towards the proximal end portion 12B. With such a configuration of the cabinet body defining a closed-loop channel $W_1$, backwave propagation sound $S_{B\text{-}W}$ is caused to circulate in the closed-loop channel while allowing the forward generated sound to propagate in the through path $W_2$ in a direction D towards the distal end, to be output from the loudspeaker. Moreover, the varying inner diameter of the cabinet body provides that different frequency components of the backwave propagation sound are directed to circulate in the closed loop waveguide $W_1$ while allowing various frequency components corresponding to the profile of the original signal to propagate in the through path $W_2$ towards the distal end 12A, thus providing a high-degree matching between the profile of the reproduced output signal and the original signal.

The embodiments of FIGS. 1A-1B and 2A-2B exemplify a coupling between the end portion 12B and the intermediate portion 12C. As shown, in these examples the proximal end portion of the body includes an extension section/part 12D extending into the intermediate portion 12C. The coupling is such that an extension part 12D of the proximal end portion 12B enters the intermediate portion and extends thereinside in a direction back from the distal end portion 12A. This provides that acoustic waves from the distal end portion and from the proximal end portion of the body are coupled to propagate in the intermediate portion of the body in the same direction thereby facilitating efficient destructive interference between them.

Figure 1B:
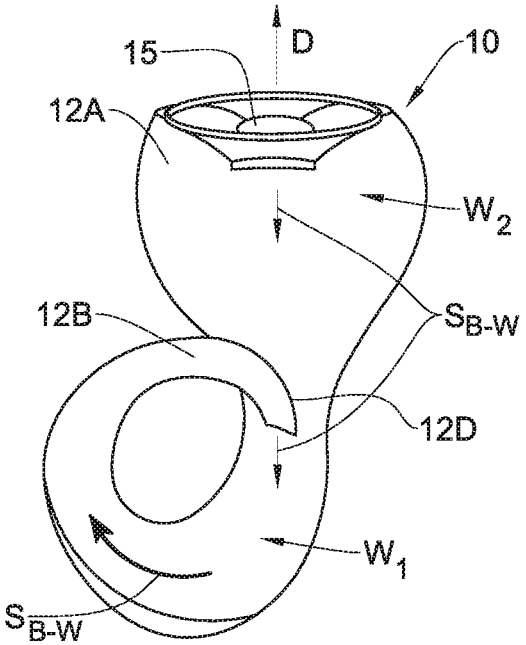
Figure 2A:
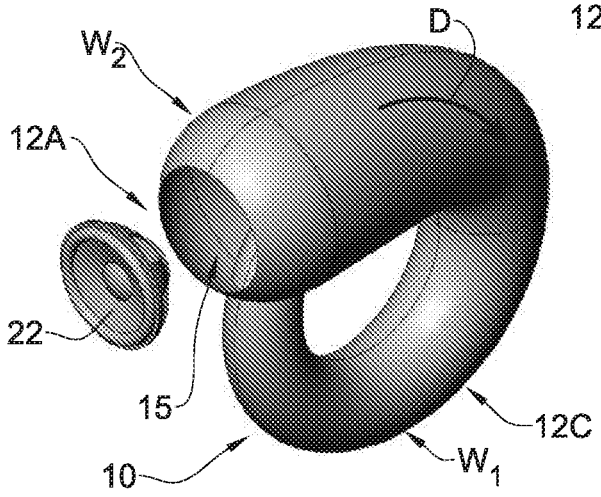
Figure 2B:
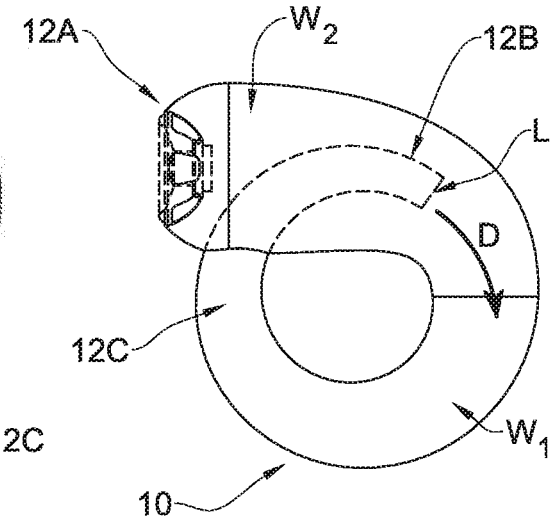

In the example of FIGS. 1A-1B, the proximal end portion 12B enters the intermediate portion 12C and the extension part 12D of the proximal end portion 12B extends along a part of the closed-loop intermediate portion 12C. In the example of FIGS. 2A-2B, the configuration is such that the proximal end portion 12B enters the distal portion 12A and the extension part 12D of the end portion 12B extends into the closed-loop intermediate portion 12C.

In the embodiments of FIGS. 3A-3C, 4A-4C, 5A-5C, and 6A-6B the configuration of the cabinet body 10 is such that the proximal end portion 12B of the body defines an aperture at a location L of an intersection (fluid coupling) of the intermediate portion 12C with itself. The aperture at the location L is configured such that the acoustic waves (back-propagating waves) from the distal end portion 12A and the acoustic waves circulating in the intermediate portion 12C are coupled at said location L to propagate in the same direction, being the circulating direction, in the intermediate portion of the body. Thus also here, efficient absorbance of the acoustic backwaves and possibly also efficient destructive interference of the backwaves is facilitated.

In this regards, it is noted that preferably according to the invention the distal end portion 12A and the proximal end portion 12B are both fluidly coupled to the intermediate portion 12C (to the closed loop) in grazing angles in order to prevent/reduce back reflections of the acoustic waves through the closed loop intermediate portion (namely prevent circulation of acoustic waves in the opposite direction). In this regards, it is understood that the phrase distal end refers to the part of the cabinet body 10 at a location between the back side of the speaker site (behind the speaker site) and the intermediate (closed loop) portion 12C.

Figure 3B:
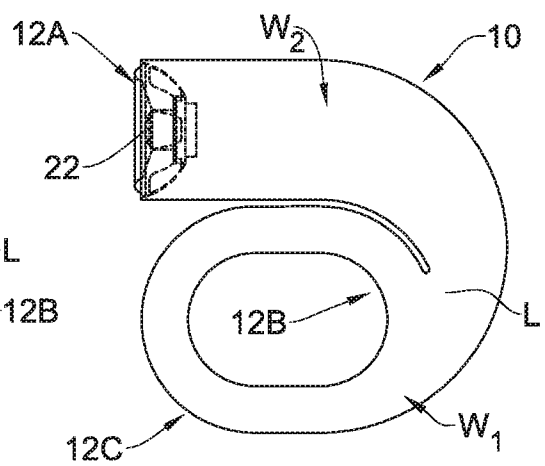
Figure 3C:
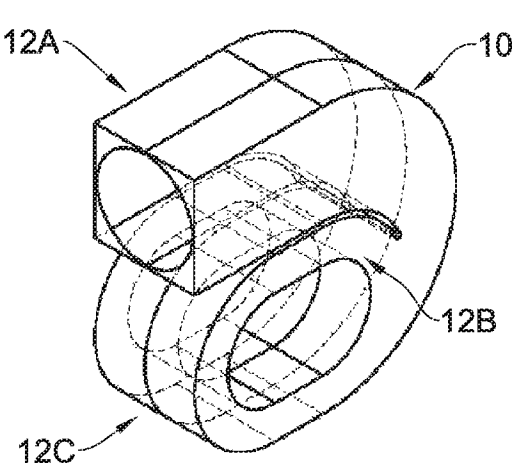
Figure 3A:
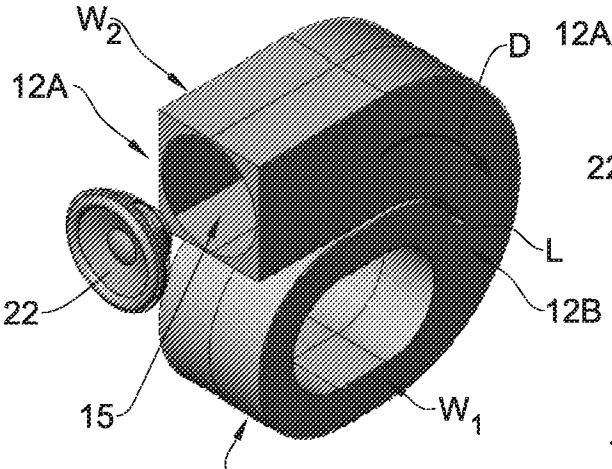

More specifically, the embodiment of FIGS. 3A-3C exemplifies that the configuration of the cabinet body 10 may be such that the end portion 12B may not intersect with the intermediate portion to penetrate into the hollow cavity of the intermediate portion. The perpetual loop is created using a junction formed by an aperture at location L where the intermediate portion 12C fluidly intersects with itself. In this specific not limiting example, the proximal end portion and the intermediate portion are stacked one above the other.

Figure 4B:
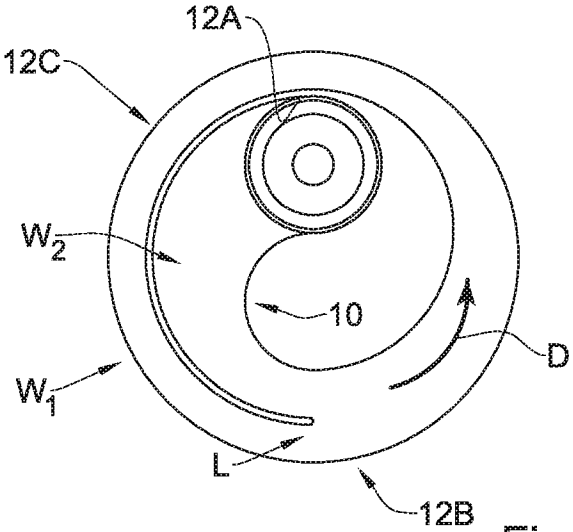
Figure 4C:
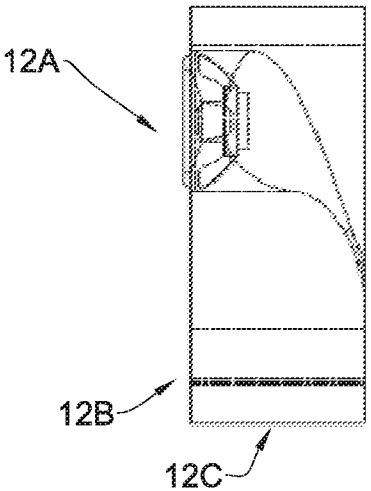
Figure 4A:
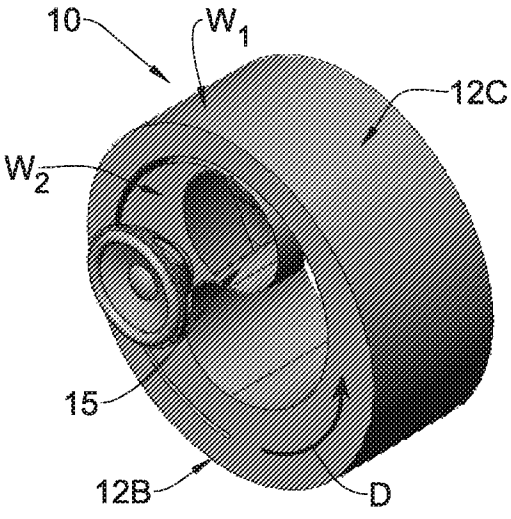
Figure 5C:
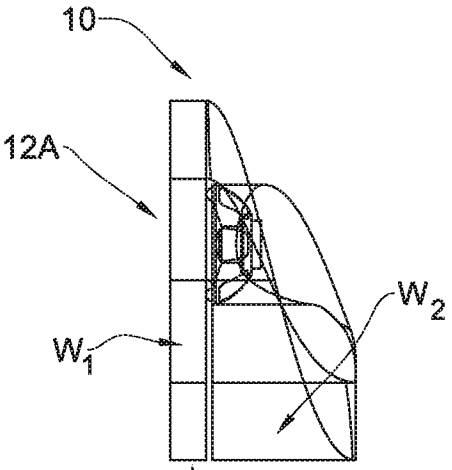
Figure 5B:
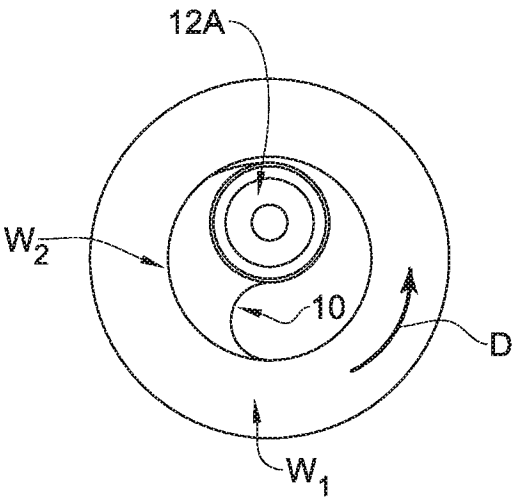
Figure 5A:
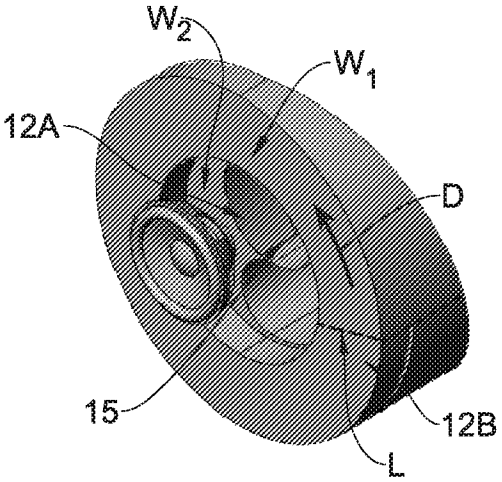
Figure 6B:
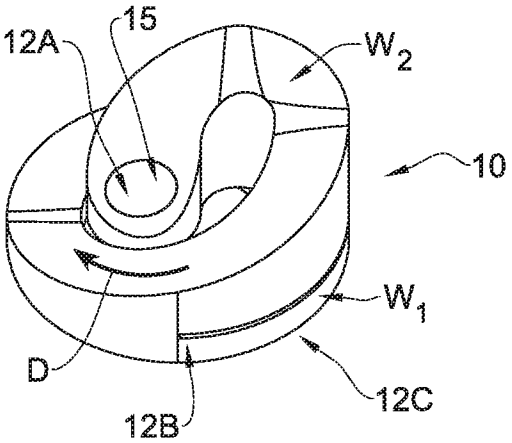
Figure 6A:
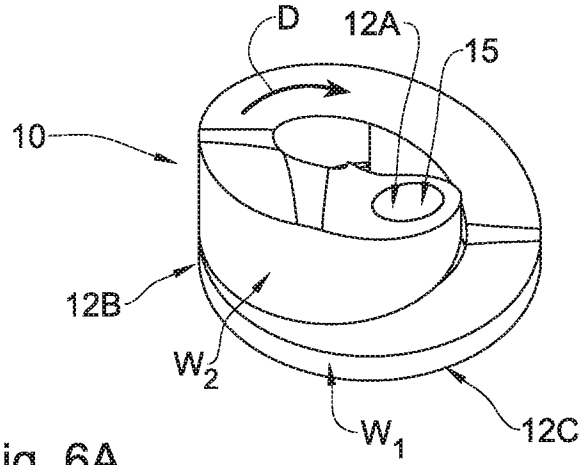

FIGS. 4A-4C, 5A-5C and 6A-6B exemplify variations of this concept. The configuration of FIGS. 4A-4C is generally similar to that of FIGS. 3A-3C in that the end portion does not intersect the intermediate portion and the two portions merge via aperture at location L while being stacked one above the other. However, in this configuration there a funnel-like geometry (the shape of the air cavity) directly behind the speaker site that directs the back-wave into the perpetual loop that now circles around the speaker site. In the examples of FIGS. 5A-5C and 6A-6B, the configurations of the cabinet body 10 are similar to the example of FIGS. 4A-4C in that there is a funnel that directs the backwave into the loop circling around the speaker site, and are similar to the example of FIGS. 3A-3C in that there is no self-intersecting geometry of the proximal end portion and intermediate portion. Here, however, in distinction to the example of FIGS. 4A-4C, the proximal end portion and intermediate portions, instead of stacking one above the other, are stacked one in front of the other (on the depth axis).

Thus, FIGS. 3A-3C, 4A-4C, 5A-5C and 6A-6B show various specific not limiting examples of the implementation/configuration of the general concept of the invention exemplified in FIGS. 1A-1B and 2A-2B according to which the cabinet body configuration defines the perpetual self-feeding loop geometry. This geometry may assume any section profile (round or with sharp edges); can be in-line with the direction of the speaker site or diverted to a different direction (i.e. the loop can be directly behind the loudspeaker or at an angle with relation to the loudspeaker by using a funnel geometry that directs the wave into the loop); can have self-intersection geometry or non-intersecting merging paths (intersecting or merging in any direction). It should be understood that this geometry refers to the shape of the air-volume/cavity behind the speaker site where the speaker unit (driver) is located, and may or may not be indicative to the external shape of the device.

Figure 7A:
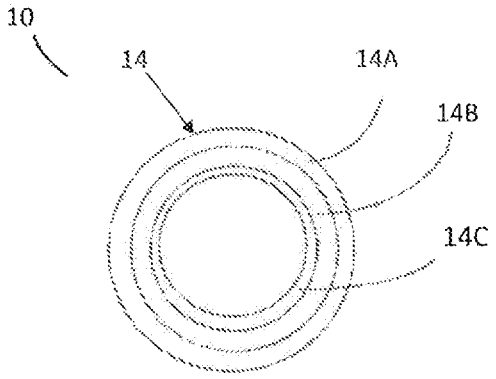
FIGS. 7A-7D schematically illustrate the principles of the invention for selecting the material composition of the cabinet body.

Reference is made to FIG. 7A illustrating an enclosure unit (cabinet body) 10 for a speaker device according to another embodiment of the present invention. The figure shows a schematic cross section of the wall of the enclosure-unit/cabinet body 10. In this embodiment, as illustrated the enclosure-unit 10 has a hollow body whereby the walls of at least a portion of the hollow body include a patterned multi-layered structure 14.

It should be understood according to this embodiment the cabinet body 10 may acquire any three dimensional shape and dimensions suited for reproducing sound in an acoustic wavelength range of interest. In this regard, the circular shape of the cross-section illustrated in the figure is only provided for clarity and for illustrative purposes and should not be construed as limiting with regards to the three dimensional shape of the cabinet body 10. For instance the outer shape three dimensional shape of the cabinet body 10, and/or the inner shape of the cavity within it, may be cubical and/or spherical/elliptical and/or may be of any other shape. Alternatively or additionally/geometrical configuration of the cabinet body may be similar to that described above with reference to any one of FIGS. 1A to 6B, as also illustrated below.

The cabinet body wall presents a structure formed by functionally different material compositions. This may be implemented as a multi-layer structure 14 as shown in the figure, or may generally be in the form of a patterned structure, namely a structure having regions of different properties with respect to the acoustic waves' propagation therein.

Such patterned structure 14 includes regions which are relatively absorbing for acoustic (sound) waves, and regions which are relatively acoustic waves' reflecting/refracting regions. As shown in the specific not limiting example of FIG. 7A, the cabinet body structure 14 is a multi-layer structure including an acoustic waves' absorber 14B, which may be a single-layer or a multi-layer structure; and outer and inner layers 14A and 14C enclosing the absorber layer therebetween. The absorber layer 14B may be made of elastomeric material composition. The layers 14A and 14C are substantially rigid and highly-reflective layers; these layers may be made of the same or different material compositions. The inner layer 14C is preferably further patterned, as will be described further below.

Figure 7B:
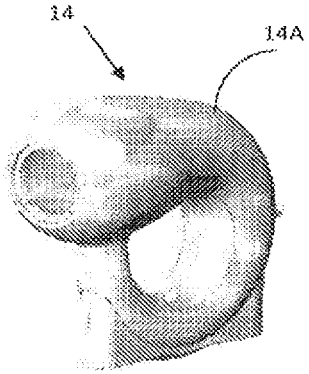
Figure 7C:
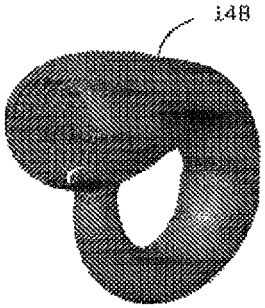
Figure 7D:
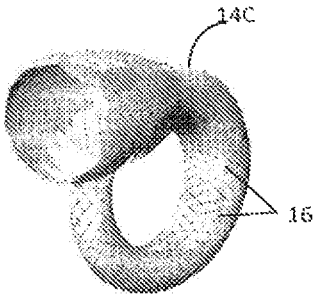

FIGS. 7B, 7C and 7D more specifically illustrate the above-described different layers of the cabinet body. For clarity, in these specific and non-limiting illustrations, the three dimensional geometry and configuration of the cabinet body is shown to be similar to that illustrated and described above with references to FIGS. 2A and 2B, which implements the closed loop geometry described above. However, as would be readily appreciated by those versed in the art the implementation of the multi-layer structure of the cabinet body walls according to the present invention is not limited to this specific geometry.

FIG. 7B is the final structure 14 of the cabinet body 10 showing the outer highly reflecting layer 14A of the cabinet body; FIG. 7C is the cabinet body without the outer layer, showing the absorbing layer 14B; and FIG. 7D shows the inner layer 14C of the body structure 14. As shown, the inner reflective layer 14C has a surface pattern (surface relief) formed by an arrangement of pattern features 16 which define refractive interfaces to direct acoustic waves interacting with/propagating through this layer to enter the absorber 14B. Moreover, these features 16 (rhomb-like in the present example) are preferably of different geometries (dimensions and/or shapes) that may include diminishing and/or fractal geometries to act as refractive interfaces for signal components of different frequencies.

It should be understood that FIGS. 7B-7D are provided just for illustrative purposes to more specifically exemplify the different layers within the construction of the cabinet body. The cabinet body may be manufactured in a common printing stage in a multi-material 3D printing process, i.e. all the layers are printed together.

One or more of layers 14A, 14B and 14C may have a varying thickness along the cabinet body. For example, the absorber layer 14B may configured such that its segment within the end portion part 12D located inside the intermediate portion 12C of the cabinet body 10 is thicker than in other segments of layer 14B.

Figure 8:
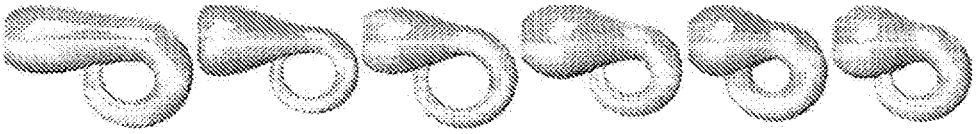
FIG. 8 exemplifies various design solutions for the cabinet body of the invention.

FIG. 8 illustrates various possible designs of the cabinet body configured utilizing the above-described principles of the present invention. The dimensions of various parts of the cabinet body, as well as material compositions, can be properly selected to optimize the sound wave propagation within the cabinet body and thus improve the performance of a loudspeaker device.

Figure 9A:
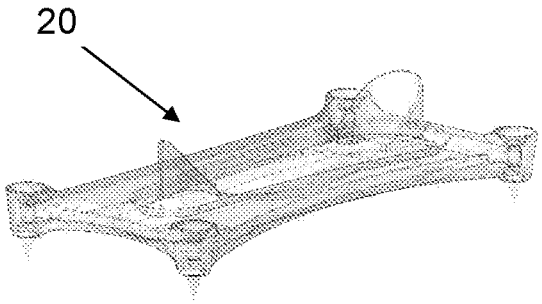
FIGS. 9A to 9K exemplify various features of the cabinet configuration.
Figure 9B:
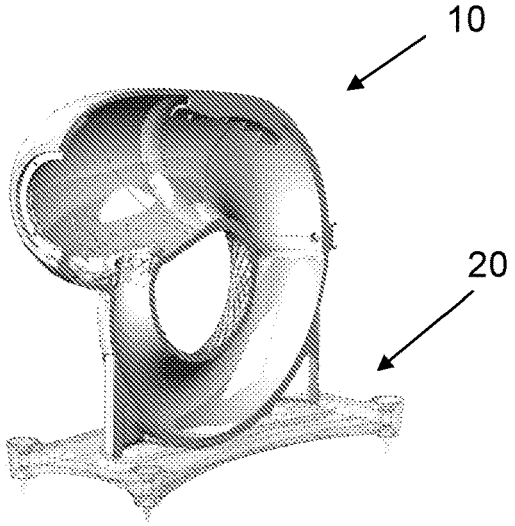
Figure 9C:
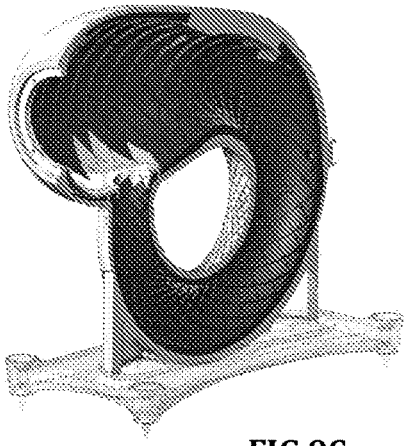
Figure 9D:
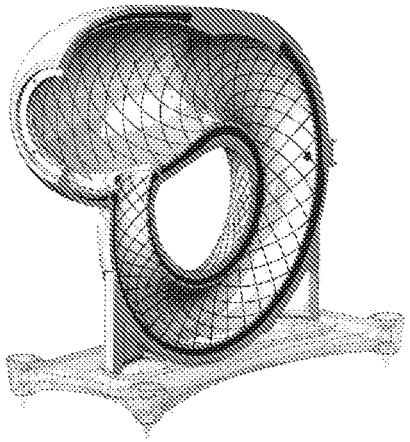
Figure 9E:
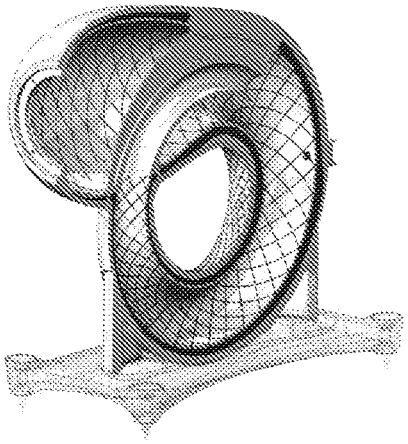
Figure 9F:
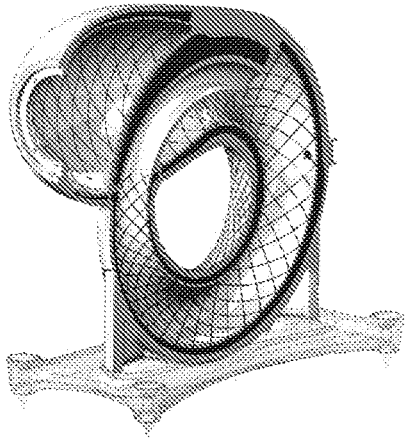
Figure 9G:
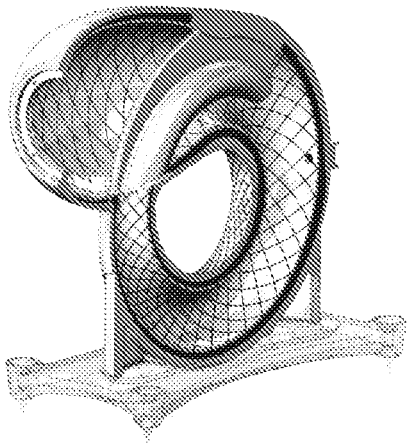
Figure 9H:
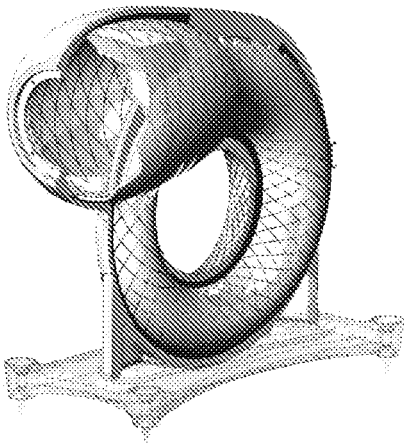
Figure 9I:
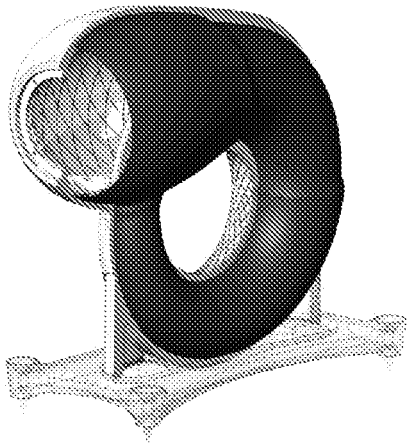
Figure 9J:
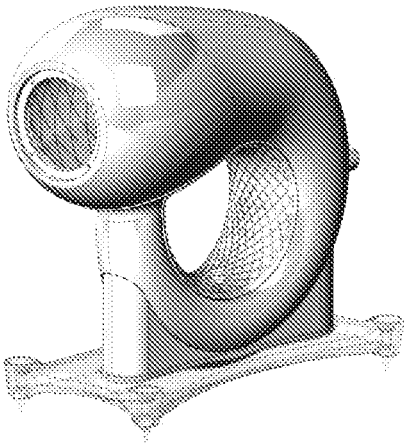

The cabinet body 10 is mounted on a support structure. A specific but not limiting example of a support structure 20 is shown in FIG. 9A. FIGS. 9B to 9J illustrate various steps of the manufacture of the loudspeaker cabinet 10 showing, in a self-explanatory manner, the above-described structural features of the cabinet body of the invention.

Figure 9K:
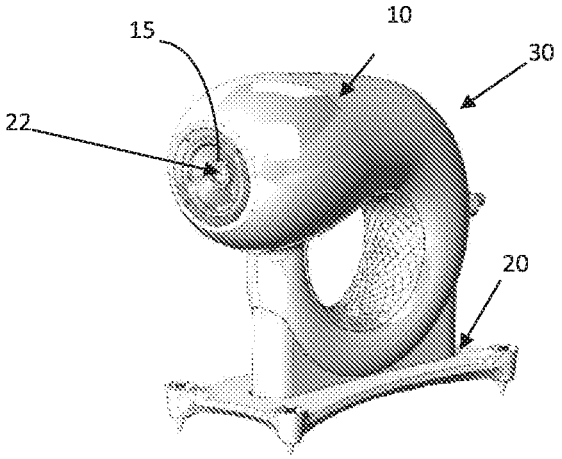

FIG. 9K shows a loudspeaker device 30 including the above-described cabinet 10 mounted on a support structure 20, and an electronic unit 22 mounted inside the cabinet at the distal portion thereof. The configuration and operation of such electronic unit are known per se and do not form part of the present invention, and therefore need not be specifically described, except to note that the electronic unit operates to convert electric signals, corresponding to the original sound (previously recorded) into sound which is to be output from the loudspeaker, and typically includes a driver and associated diaphragm. As indicated above, the coupling location between the end portion 12B of the cabinet body and its intermediate portion 12C is at the back (rear) side of the diaphragm, i.e. in the backwave propagation path.

Figure 10A:
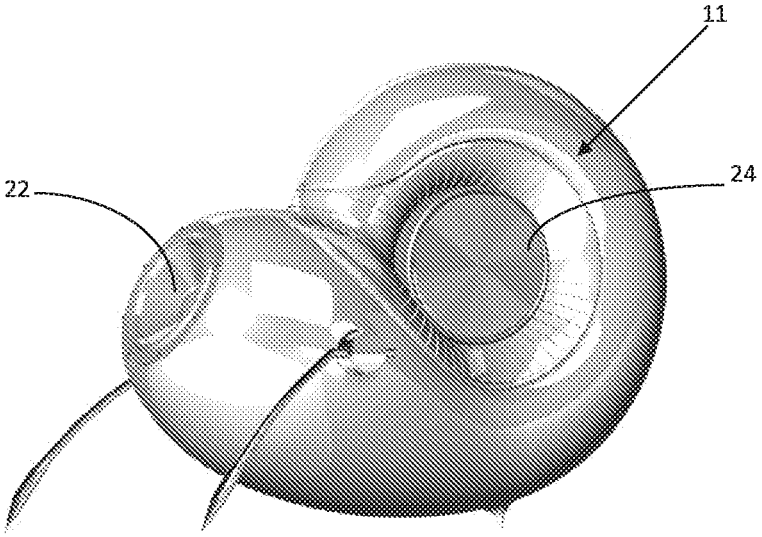
FIGS. 10A and 10B illustrate an example of the loudspeaker design configured as a subwoofer.
Figure 10B:
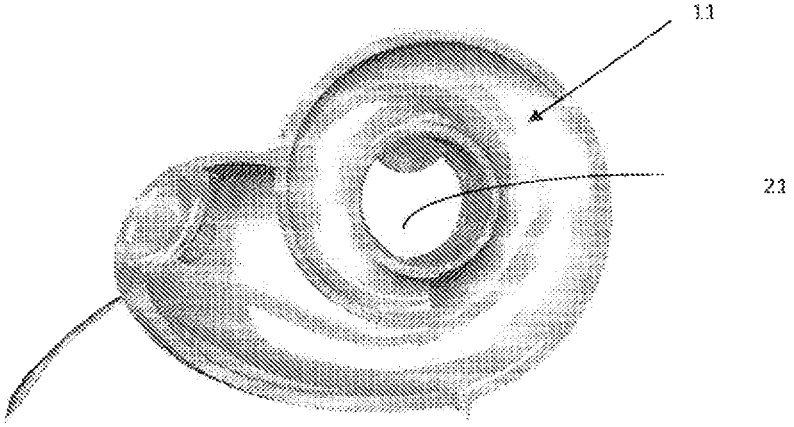

FIGS. 10A and 10B show a specific non limiting example of a loudspeaker device of the present invention, configured as a subwoofer. As shown, an opening/space 21 (FIG. 10B) defined by the toroidal-like portion 11 of the cabinet body 10 may be used for placing an amplifier unit 24 integrated in the cabinet, thus forming an active speaker (subwoofer arrangement) for reproduction of low-pitched audio frequencies (bass).

Figure 11A:
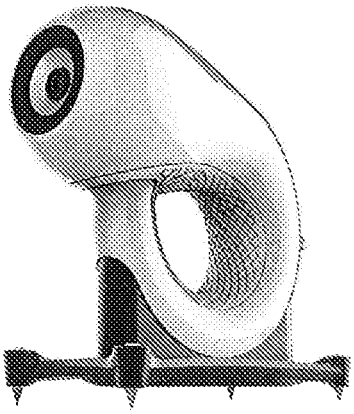
FIGS. 11A and 11B are perspective front and rear view of an experimental loudspeaker device.
Figure 11B:
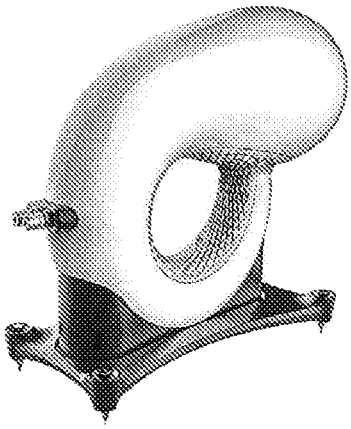
Figure 11C:
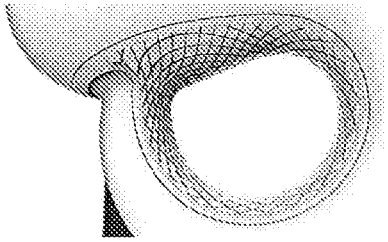
FIG. 11C more specifically illustrates the inner surface of the cabinet in the loudspeaker device of FIG. 8.
Figure 12A:
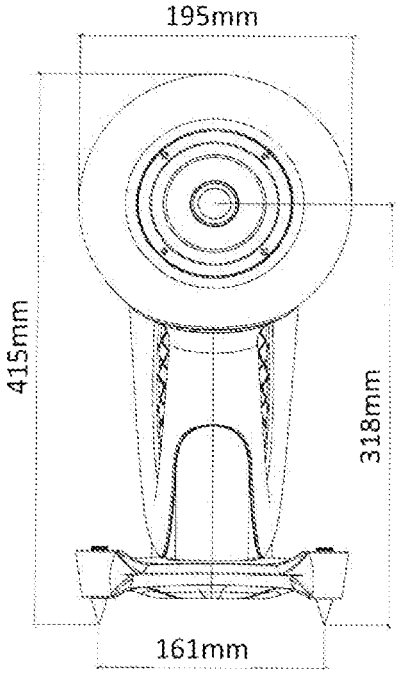
FIGS. 12A to 12F show a non-limiting example of the selection of various dimensions in the cabinet device of the invention, some being selected for optimizing the functionality of the loudspeaker and some for optimizing the design of the device.
Figure 12B:
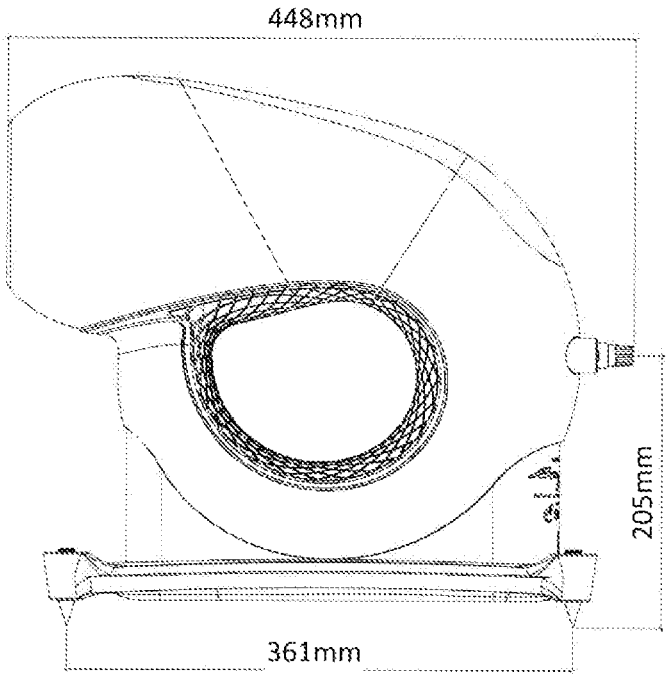
Figure 12C:
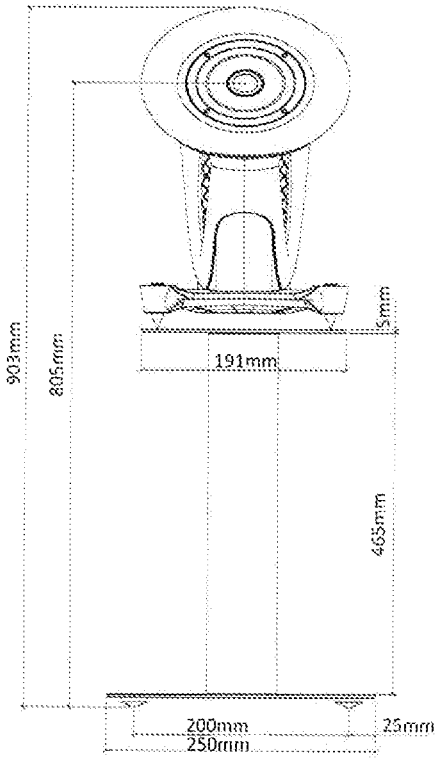
Figure 12D:
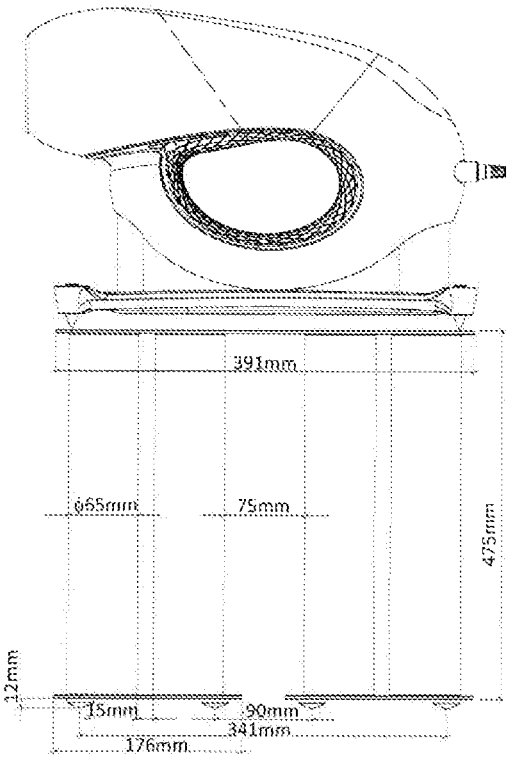
Figure 12E:
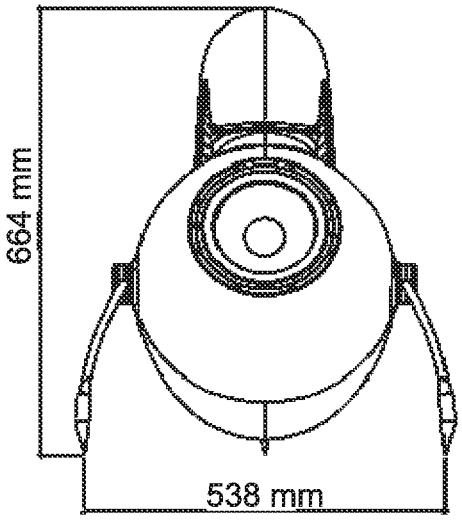
Figure 12F:
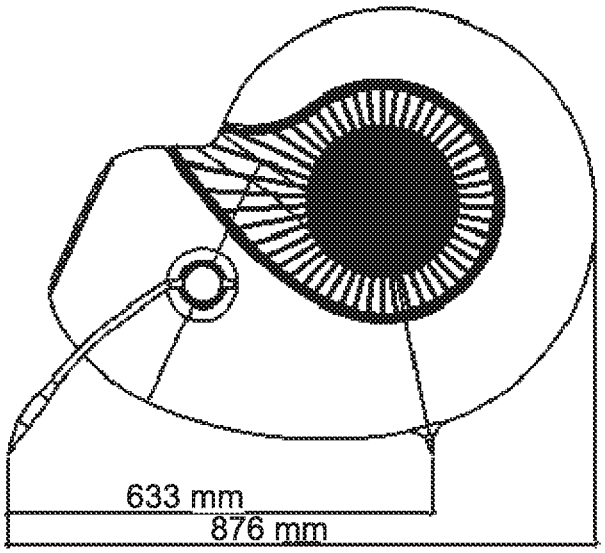
Figure 13:
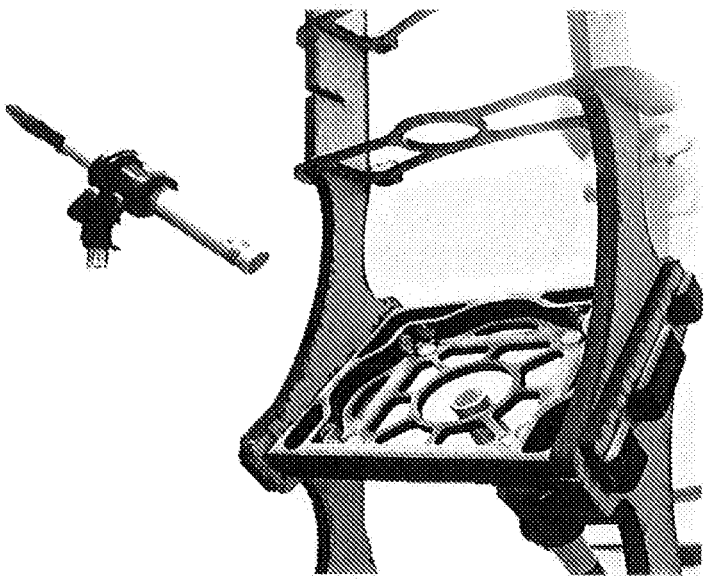
FIGS. 13 to 16 exemplify the method of the invention for 3D printing of a loudspeaker cabinet.
Figure 14:
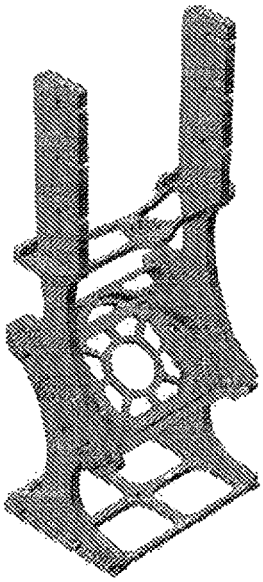
Figure 15:
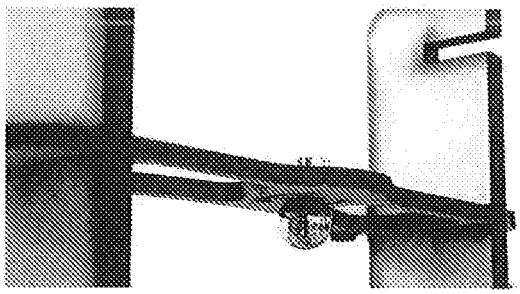
Figure 16:
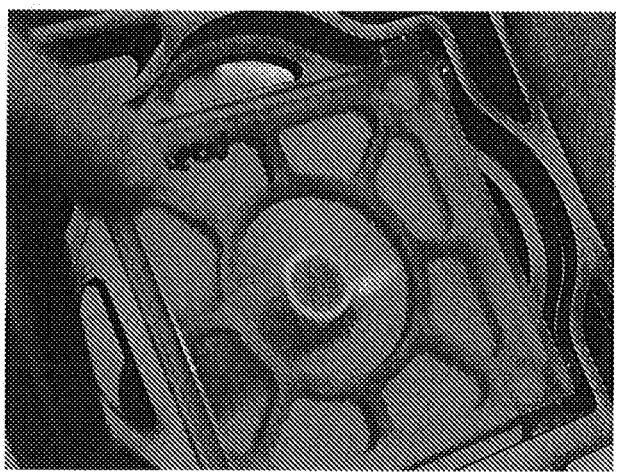

FIGS. 11A and 11B show the front and rear views of an exemplary loudspeaker device, in which the cabinet body is mounted on a support structure, and it is rear side is appropriately provided with electrical connection ports. FIG. 11C shows the patterned surface of the cabinet body, i.e. the surface of the lowermost layer 14C described above.

As indicated above, dimensions of various structural parts of the cabinet body can be properly selected for the functional and design purposes. This is exemplified in FIGS. 12A to 12F.

The above described configuration of the speaker's cabinet can be manufactures by any known suitable techniques. The following is an example of a novel method of the invention for manufacturing a loudspeaker's cabinet. This method can be used for manufacturing the above-described cabinet body of the invention, as well as any other loudspeaker's cabinet. The method of the invention provides for (but is not limited to) manufacturing the cabinet body by a 3D printing technique and/or manufacturing of the cabinet body by utilizing additive manufacturing techniques.

The inventors of the present application have studies how different 3D-printed materials and material configurations affect the acoustic response of a cabinet body of a given geometry. To this end, the inventors conducted experiments in which a steel ball is dropped from a controlled height onto a uniformly sized plate of each different material or configuration of materials ("Test Blank"). The resulting audible impact (Pulse) is recorded with condenser microphones. The uncompressed recordings are then be trimmed so that the pulse occurs at the same time on each file; this facilitates further comparisons between the recordings. The recordings are then converted to spectral "waterfall" charts displaying frequency and amplitude over time. The charts can then be visually interpreted in comparison to one another in order to make proper decision.

In this connection, reference is made to FIGS. 13 to 16 illustrating experimental setup. In order to control for the position of the test blanks, the height of the steel ball, the point of impact of the ball on the test blanks, and the microphone position in relation to the test blanks, a structure was built using laser-cut MDF (medium density fiberboard) which allows accurate and repeatable positioning between the measurements.

The structure features a "tower" with several slots that can accept a tray from which the steel ball can be released. This allows a certain degree of height adjustment (and therefore velocity) at the point of impact. The center of the structure features a platform tilted at 45 degrees with a cut-out space, and domed silicone pads on all inner corners (3 at each corner). This allows the test blanks to be loaded onto the platform in a secure and repeatable fashion with minimum contact with the structure. The 45 degree tilt ensures the steel ball ricochets away from the test blank upon impact and not strikes it twice. The structure is such that a microphone could be positioned directly below the ball's point of impact with the test blanks, which is marked with a designated hole at the bottom of the tilted platform. The entire structure rests on felt pads to decouple it from the surface on which it is placed and allow for a cleaner recording.

The steel ball used is a standard 16 mm diameter, chrome-plated steel bearing. The bearing is held up and centered against the bottom side of a round hole in the top tray with a neodymium magnet resting on the opposing side. When the magnet is removed, the bearing free-falls and strikes the test blanks at the same spot and with consistent velocity.

The microphones used for the audio recording are a stereo-matched pair of Samson C02 pencil condensers. One was positioned directly beneath the point of impact on the test blank, the other was positioned top-side pointing down towards the center of the test blank and offset to the side at roughly a 30 degree angle.

Figure 17:
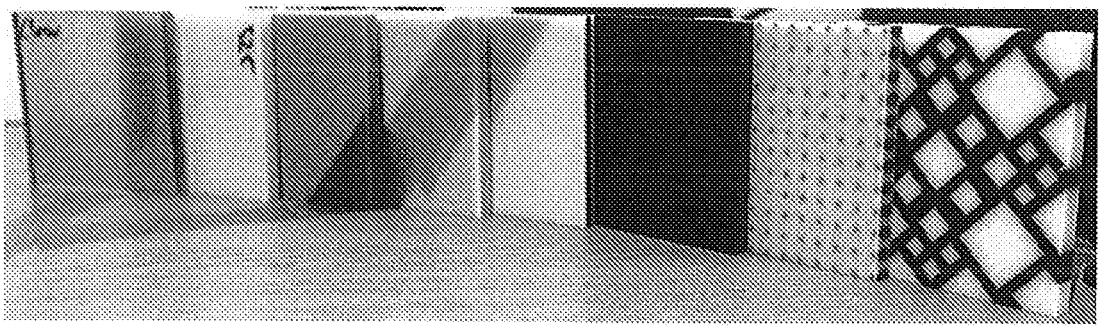
FIGS. 17 and 18A-18J illustrate simulation/experimental results for material selection for the loudspeaker cabinet body.

FIG. 17 illustrates the test blanks which include 100×100×10 mm (width×length×height) 3D-printed blocks of different materials and configurations. The combination of the different materials having the different mechanical properties, result in different acoustical absorbance/reflectance properties and provides for achieving the desired acoustical properties of the patterned structure, and faithful reproduction of sound. The inventor experimented with different material configurations in order to determine the best performing combination and structure for implementation in a speaker enclosure. In these experimental setups the following material combinations (test blanks) were used in the multi-layer/patterned structure of the speaker's enclosure to provide good acoustical and mechanical/structural properties for the speaker's enclosure:

Blank A: Homogenous block, repeated for several materials including: Transparent photopolymer such as Vero Clear™, ABS-like photopolymer such as Digital ABS™, Support-Filled heat resistant photopolymer such as RGD525™.

Blank B: A layer of flexible material such as an Elastic photopolymer (e.g. TangoBlackPlus™) sandwiched between two layers of rigid material, such as high detail photopolymer (e.g. VeroWhite™), with the flexible layer being twice the thickness of the sandwiching layers resulting in a 1:2:1 layer thickness ratio and a 1:1 total material ratio.

Blank C: several layers of flexible materials (e.g. Elastic photopolymer such as TangoBlackPlus™) and rigid materials (e.g. high detail photopolymer such as VeroWhite™) structured one on top of the other in an alternating order. In some embodiments Blank C includes ten alternating layers of the above two materials with even thicknesses, resulting in a 1:1 total material ratio. Preferably the layer of the flexible material is exposed on one side of the blank, and the layer of rigid material is exposed on the other.

Blank D: A layer of flexible material (e.g. Elastic photopolymer such as TangoBlackPlus™) sandwiched between two layers of rigid material (e.g. high detail photopolymer such as VeroWhite™), with all layers being even in thickness resulting in a 1:1:1 layer thickness ratio and a 2:1 total material ratio in favor of the rigid material.

Blank E: An inner core of flexible material (e.g. Elastic photopolymer such as TangoBlackPlus™) encased in a continuous exterior shell of uniform thickness rigid material (e.g. high detail photopolymer such as VeroWhite™) at a 1:1 total material ratio.

Blank F: Square blocks of varying sizes of rigid material (e.g. high detail photopolymer such as VeroWhite™) separated by "walls" of flexible material (e.g. Elastic photopolymer such as TangoBlackPlus™) resulting in a continuous flexible structure with embedded isolated segments of rigid blocks with a 1.8:1 total material ratio in favor of the rigid material.

Blank G: A "molecular" structure of flexible material (e.g. Elastic photopolymer such as TangoBlackPlus™) embedded within a continuous block of rigid material (e.g. high detail photopolymer such as VeroWhite™) with a total material ratio of 2.3:1 in favor of the rigid material.

In this regards, it is noted that in some embodiments of the present invention, most or all the materials which are used to construct the speaker's enclosure may be polymers, such as curable polymers (e.g. photo-polymers). Accordingly according to some embodiments the present invention provides a novel technique for fabricating a speaker's enclosure, such as that described above by utilizing 3D printing (e.g. PolyJet 3D printing with UV curing in case photopolymers are used). and/or other additive manufacturing techniques, to construct the patterned structure of the enclosure from polymers, preferably photopolymers, such as those indicated above. Utilizing these techniques any one of the above described Blank A to Blank G patterned/multi-layered structures can be manufactured, as well as possibly other multi-layer configurations of the speaker enclosure.

Indeed in other embodiments of the present invention other combinations of the mechanically different materials i.e. rigid and flexible (e.g. metal(s) and plastic(s)) may also be used (configured as described above) to construct the speaker's enclosure (the patterned/multi-layer structure thereof) in the manner described above.

FIGS. 18A to 18J show the measurement results for the above test blanks. Each of these figures shows the signal response of the cabinet body, in the form of amplitude of the impulse response as a function of frequency and time. The graphs show the particular frequencies decaying over time. In these experiments, there are four or five frequencies, or may be six, depending on the chosen amplitude threshold. It means that there are certain frequency bands that are amplified, and the rest are not. It is important to point out that number "2" on the frequency scale corresponds to 20,000 Hz, which is the limit of human hearing: anything between 2 and 4.5 cannot be heard.

Figure 18A:
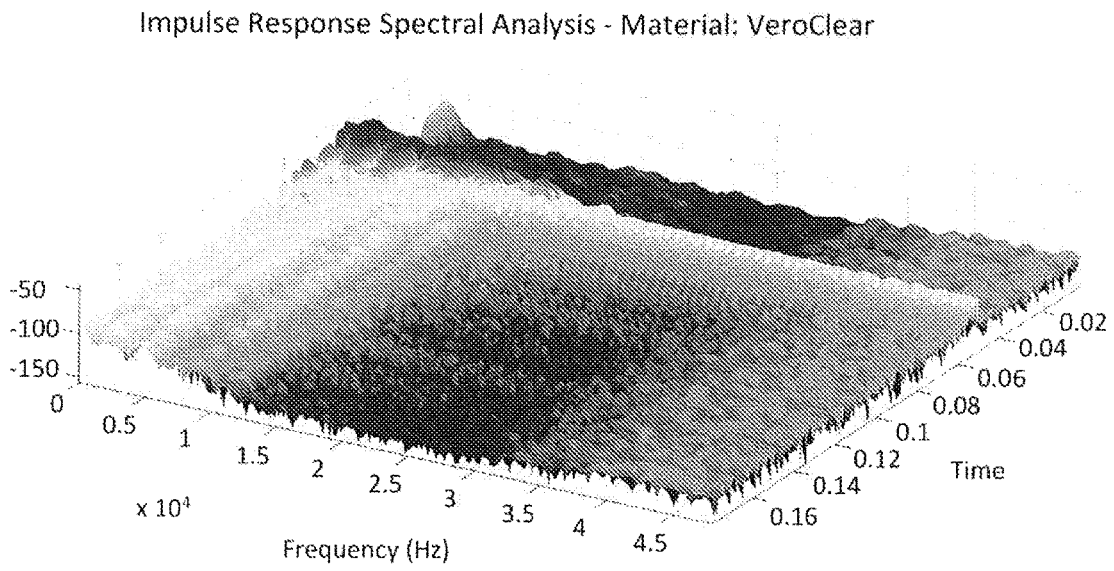
Figure 18B:
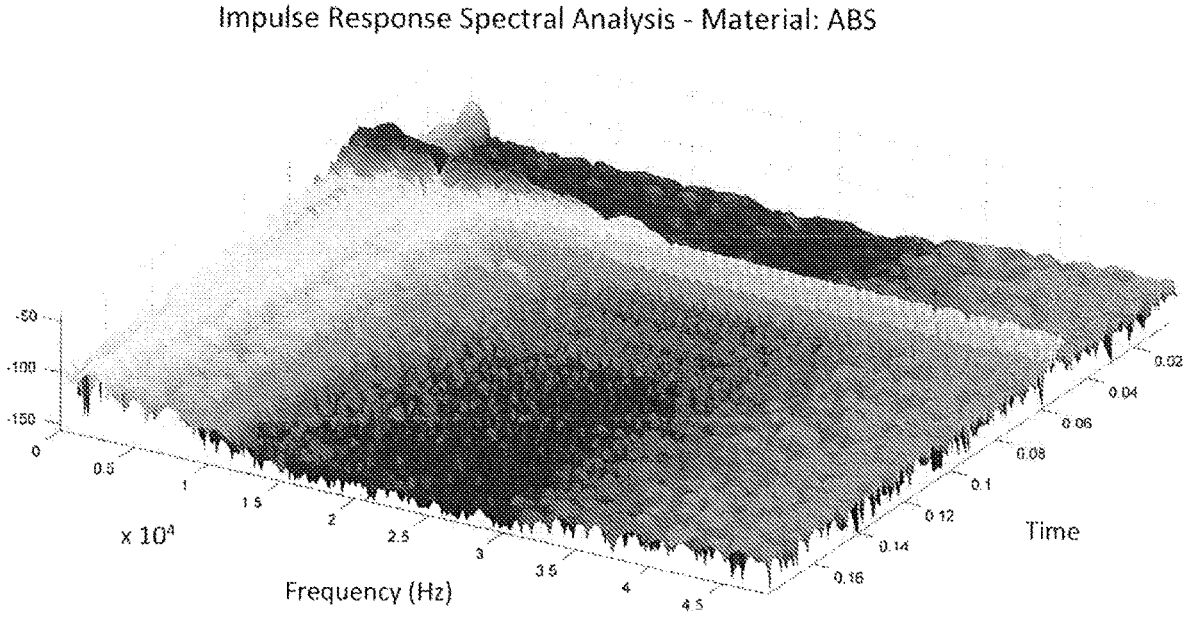
Figure 18C:
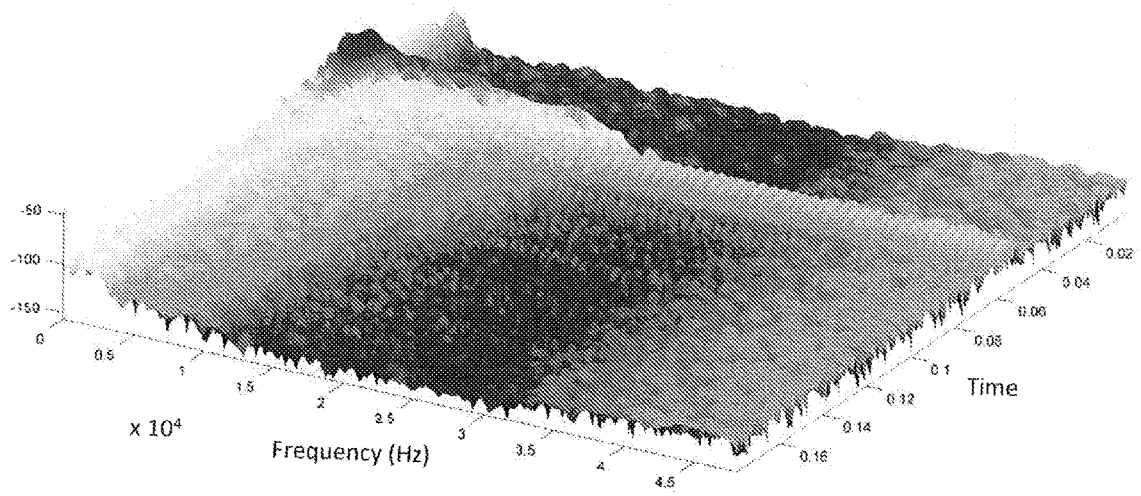
Figure 18D:
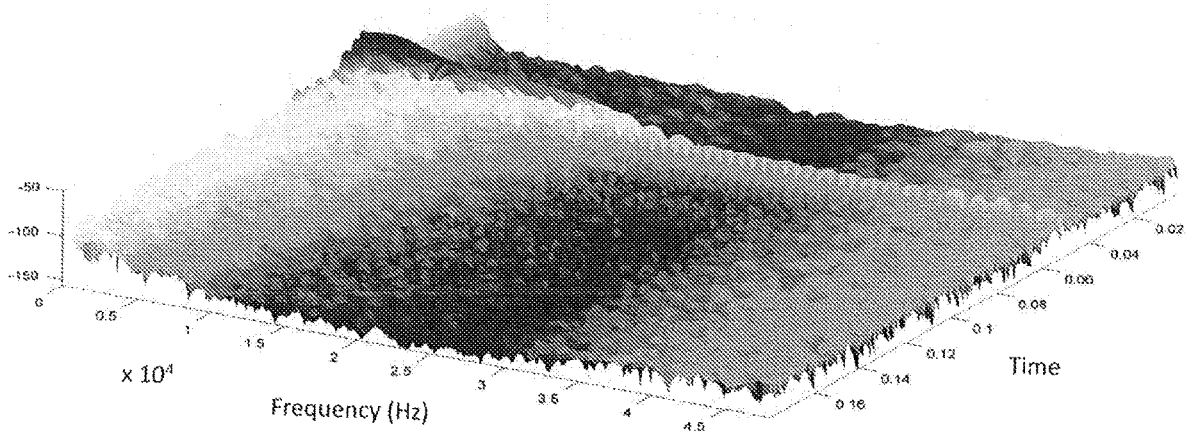
Figure 18E:
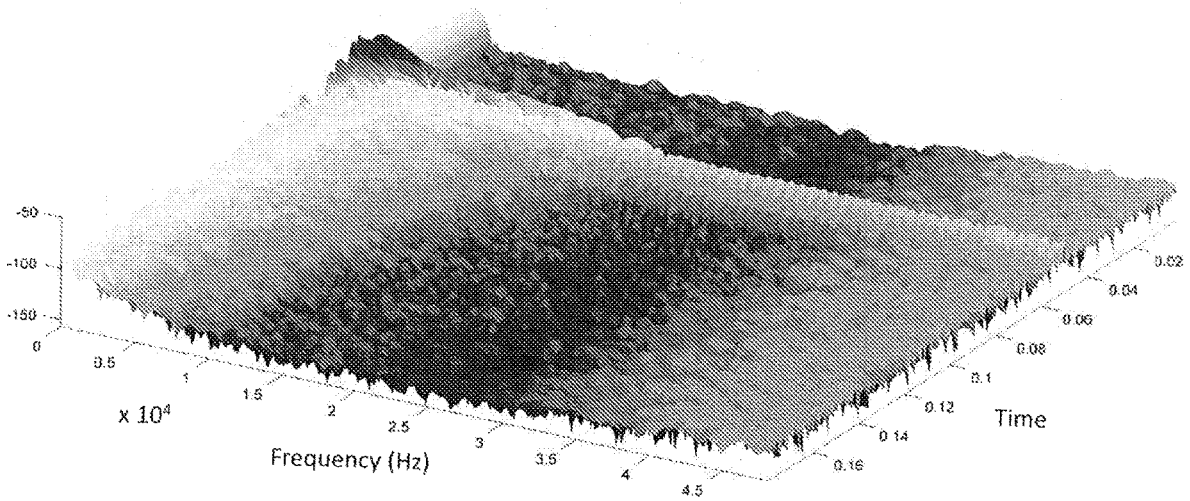
Figure 18F:
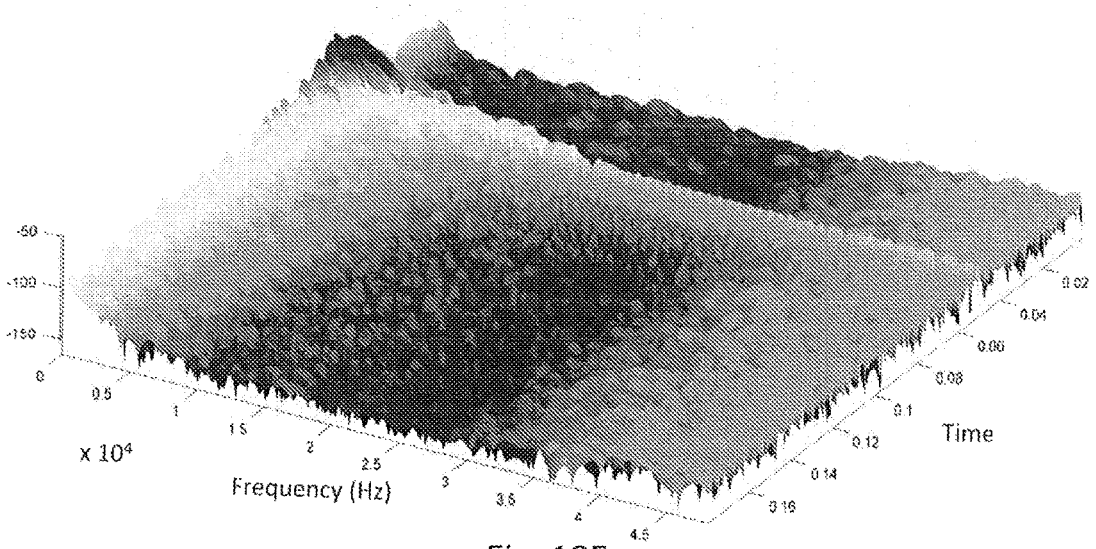
Figure 18G:
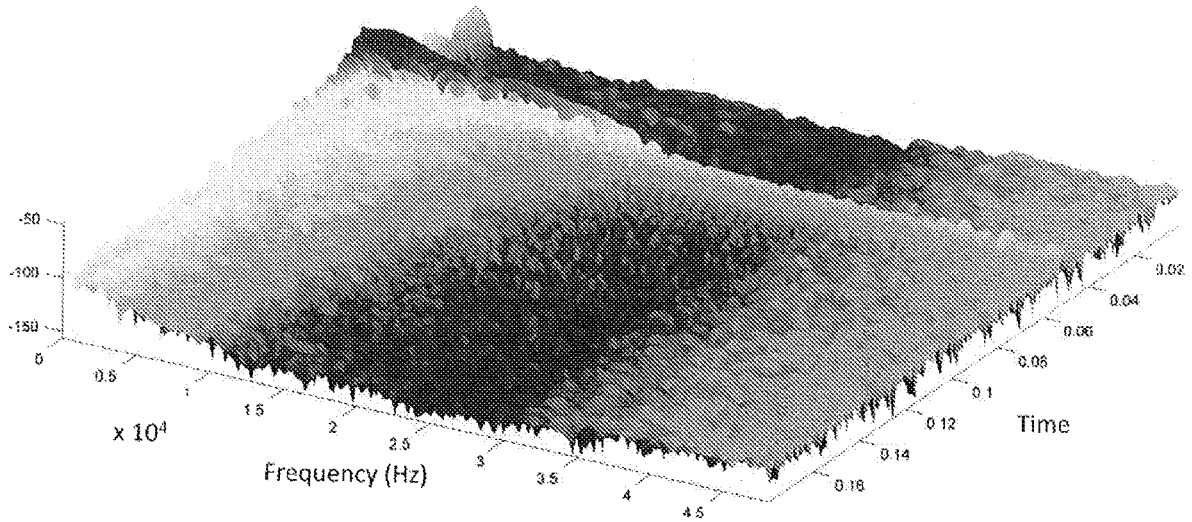
Figure 18H:
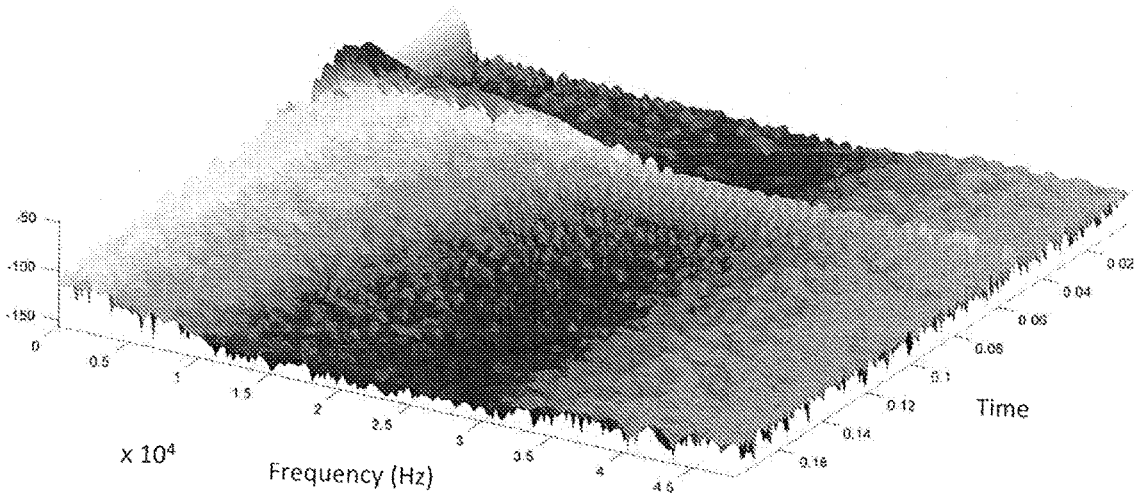
Figure 18I:
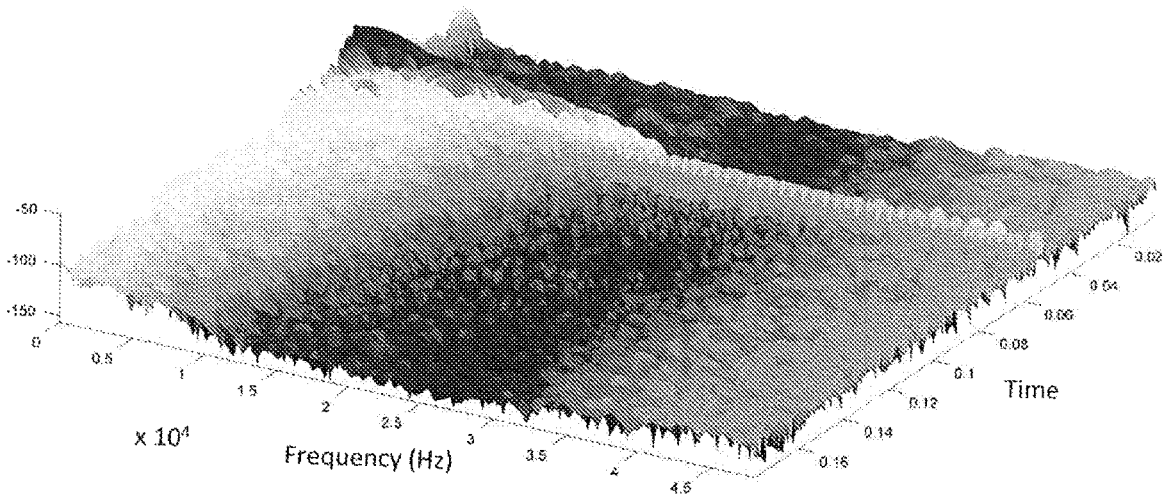
Figure 18J:
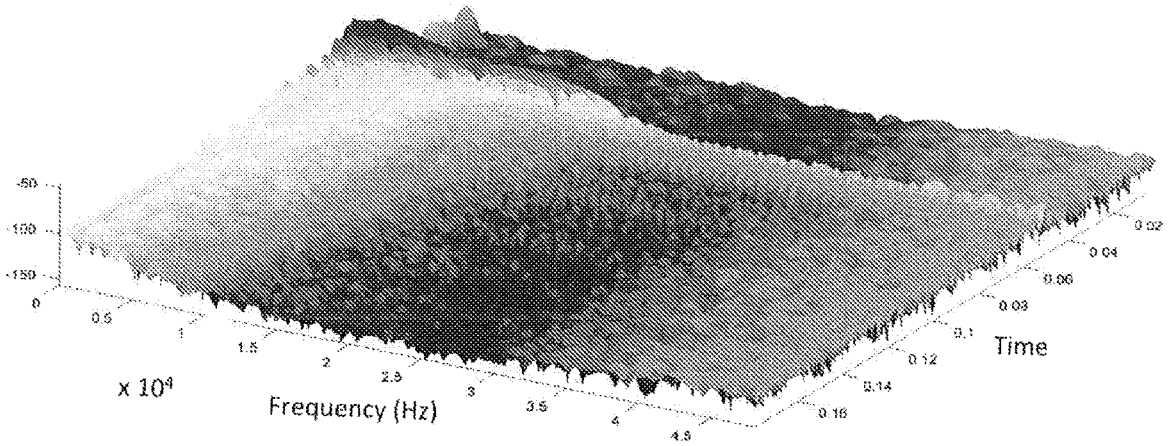

FIGS. 18A, 18B and 18C correspond to the BlankA being, respectively, VeroClear™, DigitalABS™, and Support-filled RGD525™. FIG. 18D corresponds to BlankB material composition. FIGS. 18E and 18F correspond to BlankC being, respectively, VeroWhite™ and TangoBlackPlus™. FIGS. 18G-18J correspond to respectively, BlankD, BlankE, BlankF, BlankG.

With regard to different instances of Blank A, it is shows that both DigitalABS™ and VeroClear™ blocks feature numerous (4~6) distinct frequencies whose response is loudest and slowest to decay. The RGD525™ block performed similarly to the multi-material blanks, featuring only 1 or 2 dominant frequencies in the bass spectrum that are loudest and slowest to decay and yet still not as loud and not as slow to decay as the homogenous blocks. This is a result of the RGD252™ block being a multi-material blank in and of itself, much like Blank D, being a support-filled structure.

Comparison between the results for Blanks B and C (VeroWhite™) shows that the multi-layered Blank C is characterized by faster decay across the measured frequency spectrum.

Comparing Blanks B and D (considering a ratio between rigid and flexible material) shows that Blank D's material ratio favors the rigid material resulted in faster decay. It should, however, be noted that this does not mean that removing the flexible material altogether would result in the fastest decay times, as demonstrated by the Blank A measurements.

Comparing Blanks B and E (continuity vs separation), shows that Blank E's inner flexible core incased within a continuous hollow shell results in quicker decay over Blank B's "free-floating" layered structure.

Comparison between Blank C (TangoBlackPlus™) and Blank C (VeroWhite™) shows that the rigid impact surface features more information in the higher frequencies than the flexible material, which is distinctively louder in the bass spectrum. Using the rigid material as an impact surface results in a more even response and decay across the measured frequency spectrum. Having the flexible material as an impact surface results in lower amplitude and faster decay in the mid-high frequencies, yet higher amplitude and slower decay in the bass spectrum.

Blanks F and G, being dissimilar to the other blanks and not controlling for anything, both feature total material ratios favoring the rigid material and both produce more even responses and quicker decay times compared to all the homogenous blanks and many of the multi-material blanks Blank F with its "isolated islands" structure produces quicker decay times across the measured frequency spectrum compared to Blank G's continues rigid block with embedded flexible structure. This contradiction to the previous observation, which implied that a continuous structure performs better, could be explained by the different ratios of materials between the blanks. However, the different material ratios between Blanks F and G indicate that it is Blank G which should perform better. Hence, there might be a ratio "sweet-spot" of rigid and flexible materials that produces the quickest decay times. The shape (or geometric distribution) of the flexible and rigid materials within a given geometry makes a significant difference to the acoustic response, which might be even greater than the ratio between the materials.

In view of the above the applicant have found that optimal acoustic performance and structural integrity of the enclosure can be achieved in embodiments of the present invention in which the enclosure includes at least two rigid layers sandwiching at least one elastic absorptive layer, and preferably where the inner layer is fragmented into separate segments/fragments.

Thus, the present invention provides a novel approach for configuring the cabinet body of a loudspeaker. This approach provides for optimizing the cabinet body configuration from both the functionality and design points of view. The cabinet body of the invention provides for improving the loudspeaker performance by reducing the backwave distortion effects and providing desired cabinet neutrality.

The invention claimed is:

1. An enclosure unit for a speaker device, the enclosure unit comprising an integral elongated hollow body defining a cavity for mounting therein an electronic unit of the speaker, said hollow body having a distal end portion, defining an open end of the enclosure unit through which sound reproduced by said electronic unit is output, a proximal end portion having an open end, and an intermediate portion in between the distal end and proximal end portions, wherein the proximal end portion of the body is coupled to the intermediate portion at a certain location on the intermediate portion thereby defining a toroidal-like portion of the hollow body, and wherein a cross sectional dimension of an interior of the hollow body reduces from the distal end portion towards the proximal end portion, wherein said hollow body is a patterned structure comprising regions configured and operable as an absorber for predetermined range of acoustic radiation, and regions being substantially reflective and refractive for said range of acoustic radiation, wherein said patterned structure is a multi-layer structure comprising a layer of said absorber, enclosed between outer and inner layers having said substantially reflective and refractive regions.

2. The enclosure unit according to claim 1, wherein the proximal end portion partially enters the intermediate portion at said location and extends inside the intermediate portion from said location in a direction back from the distal end portion.

3. The enclosure unit according to claim 1, wherein the intermediate portion has the form of a closed loop acoustical propagation channel and wherein the proximal end portion defines an aperture for fluid communication of said intermediate portion at an intersection of said intermediate portion with itself.

4. The enclosure unit according to claim 1, wherein said hollow body defines an integral waveguide structure for sound propagation therethrough formed by a closed-loop waveguide channel defined by said toroidal-like portion and a through path channel defined by a portion of the hollow body between said coupling location on the intermediate portion associated with the distal end portion.

5. The enclosure unit according to claim 4, wherein said distal end portion is coupled to said closed-loop waveguide channel at a grazing angle.

6. The enclosure unit according to claim 4, wherein said coupling location is located at the intermediate portion with respect to said cavity for locating the electronic unit such that, in operation, acoustic waves generated by the electronic unit and propagating in a backward direction circulate in said closed-loop waveguide channel.

7. The enclosure unit according to claim 1, wherein said inner and outer layers are substantially rigid layers.

8. The enclosure unit according to claim 1, wherein said inner layer is configured as a patterned structure comprising features configured as refractive interfaces for the acoustic waves, thereby directing the acoustic waves interacting with said interfaces to enter the absorber.

9. The enclosure unit according to claim 8, wherein said features of the patterned structure have different lattice and/or diminishing and/or fractal geometries for refracting different frequency components in the acoustic waves.

10. The enclosure unit according to claim 1, carrying an acoustic transducer mounted in an opening defined by said distal end portion.

11. A loudspeaker device comprising the enclosure unit of claim 1, and an electronic unit configured for converting electric signals corresponding to an original sound into reproduced output sound.

12. The loudspeaker device according to claim 11, wherein the electronic unit is located inside the hollow body of the enclosure unit at a location closer to the distal end portion of the hollow body.

13. A loudspeaker device comprising an enclosure unit comprising an integral elongated hollow body which carries an electronic unit comprising an acoustic transducer converting electric signals corresponding to an original sound into reproduced output sound, wherein said integral elongated hollow body defines an inner cavity for mounting therein said electronic unit, and has a distal end portion, defining an open end of the enclosure unit through which sound reproduced by said electronic unit is output, a proximal end portion having an open end, and an intermediate portion in between the distal and end portions, the proximal end portion of the body being coupled to the intermediate portion at a certain location on the intermediate portion thereby defining a toroidal-like portion of the hollow body, said acoustic transducer being mounted within an opening defined by said distal end portion, wherein said hollow body is a patterned structure comprising regions configured and operable as an absorber for predetermined range of acoustic radiation, and regions being substantially reflective and refractive for said range of acoustic radiation, wherein said patterned structure is a multi-layer structure comprising a layer of said absorber, enclosed between outer and inner layers having said substantially reflective and refractive regions.

14. An enclosure unit for a speaker device, the enclosure unit comprising an integral hollow body whereby said hollow body comprises:

a distal end portion defining a cavity for mounting therein an acoustic transducer of the speaker device and having an open end through which forward propagating acoustical waves from said acoustic transducer output;

a closed-loop acoustic waveguide channel fluidly connected to said distal end portion, arranged for receiving back propagating acoustical waves emanating from said acoustic transducer, and configured and operable for guiding said back propagating acoustical waves for propagation in the closed-loop in a perpetuating fashion until intensity of said pack propagating acoustical waves is diminished; and a proximal end portion having an open end, and an intermediate portion fluidly connected in between the distal end and the proximal end portions, and wherein the open end of said proximal end portion is fluidly coupled to the intermediate portion of the body at a certain location along the intermediate portion such that acoustical waves propagating through said intermediate portion towards said open end of the proximal end portion re-enter in to said intermediate portion after crossing the open end of the proximal end portion, the intermediate and proximal-end portions thereby defining said closed-loop acoustic waveguide channel of the hollow body, wherein said hollow body is a patterned structure comprising regions configured and operable as an absorber for predetermined range of acoustic radiation, and regions being substantially reflective and refractive for said range of acoustic radiation, wherein said patterned structure is a multi-layer structure comprising a layer of said absorber, enclosed between outer and inner layers having said substantially reflective and refractive regions.

15. The enclosure unit according to claim 14 wherein a cross sectional dimension of an interior of the closed-loop acoustic waveguide channel of the hollow body reduces from the intermediate portion towards the proximal end portion.

16. The enclosure unit according to claim 14, wherein at least said intermediate portion of the hollow body is configured for absorbing a predetermined range of acoustic wavelengths and thereby reducing the intensity of the back propagating acoustical waves when they propagate in said closed loop waveguide channel.

17. The enclosure unit according to claim 16, wherein at least said intermediate portion of the hollow body includes a patterned structure defining walls of said intermediate portion and wherein said patterned structure comprises: one or more absorber regions configured and operable for absorbing said predetermined range of acoustic wavelengths, and regions having at least one of substantially reflective and substantially refractive properties for said range of acoustic wavelengths.

18. The enclosure unit according to claim 17, wherein said patterned structure is a multi-layer structure comprising a layer of said absorber, enclosed between substantially outer and inner layers and wherein said inner layer is substantially rigid and includes a pattern of features configured as refractive interfaces for directing at least some of the acoustic waves interacting with said interfaces towards said absorber.

19. An enclosure unit for a speaker device, the enclosure unit comprising a hollow body defining a cavity for mounting therein an acoustic transducer of the speaker device and having an open end through which forward propagating acoustical waves from said acoustic transducer output, and wherein walls of at least a portion of the hollow body include a patterned multi-layered structure comprising at least one absorber layer enclosed between outer and inner layers wherein said at least one absorber layer is configured and operable for absorbing a predetermined range of acoustic wavelengths, said inner and outer layers are substantially rigid layers having at least one of substantially reflective and substantially refractive properties for said range of acoustic wavelengths, and said inner layer includes a pattern of features configured as refractive interfaces for directing at least some of the acoustic waves interacting with said interfaces towards said absorber layer.

* * * * *